US008075222B2

(12) United States Patent
Quenzi et al.

(10) Patent No.: US 8,075,222 B2
(45) Date of Patent: Dec. 13, 2011

(54) CONCRETE FINISHING APPARATUS

(75) Inventors: Philip J. Quenzi, Atlantic Mine, MI (US); David W. Somero, New Ipswich, NH (US); Tracy L. Matson, Sophia, NC (US)

(73) Assignee: Somero Enterprises, Inc., Fort Myers, FL (US)

( * ) Notice: Subject to any disclaimer, the term of this patent is extended or adjusted under 35 U.S.C. 154(b) by 0 days.

(21) Appl. No.: 13/025,577

(22) Filed: Feb. 11, 2011

(65) Prior Publication Data

US 2011/0135388 A1 Jun. 9, 2011

Related U.S. Application Data

(63) Continuation of application No. 12/394,271, filed on Feb. 27, 2009, now Pat. No. 7,891,906.

(60) Provisional application No. 61/031,796, filed on Feb. 27, 2008.

(51) Int. Cl.
*E01C 19/22* (2006.01)

(52) U.S. Cl. ..... 404/112

(58) Field of Classification Search ..... 404/112, 404/84.05

See application file for complete search history.

(56) References Cited

U.S. PATENT DOCUMENTS

| | | | | |
|---|---|---|---|---|
| 791,726 | A | 6/1905 | Schutte | |
| 842,770 | A | 1/1907 | Connelly | |
| 1,695,202 | A | 12/1928 | Newell | |
| 1,828,576 | A * | 10/1931 | Palatini | 404/112 |
| 1,955,101 | A | 4/1934 | Sloan | |
| 2,009,542 | A | 7/1935 | Day | |
| 2,032,205 | A | 2/1936 | Gage | |
| 2,180,198 | A | 11/1939 | Day | |
| 2,219,246 | A | 10/1940 | Jackson | |
| 2,248,247 | A | 7/1941 | Nichols | |
| 2,255,343 | A | 9/1941 | Baily | |
| 2,296,453 | A | 9/1942 | Saffert | |
| 2,303,335 | A | 12/1942 | Day | |
| 2,314,985 | A | 3/1943 | Jackson | |
| 2,373,828 | A | 4/1945 | Harrington | |

(Continued)

FOREIGN PATENT DOCUMENTS

| | | |
|---|---|---|
| CA | 2051776 | 12/1995 |

(Continued)

OTHER PUBLICATIONS

International Search Report and Written Opinion dated Jan. 8, 2010 for corresponding PCT Application No. PCT/US2009/035397, filed Feb. 27, 2009.

*Primary Examiner* — Raymond Addie

(57) ABSTRACT

A concrete finishing apparatus for smoothing and leveling partially set-up concrete at a support surface includes a frame portion, a first concrete working member and a second concrete working member disposed at the frame portion. The first concrete working member is rotatable about a first axis of rotation that is generally vertical when the first concrete working member is supported at a generally horizontal support surface. The second concrete working member is rotatable about a second axis of rotation that is generally vertical when the second concrete working member is supported at a generally horizontal support surface. The first and second concrete working members engage the partially set-up concrete surface at the support surface and rotate about the first and second axes of rotation to process the concrete surface.

22 Claims, 17 Drawing Sheets

U.S. PATENT DOCUMENTS 2,378,065 A 6/1945 Crock
2,386,662 A 10/1945 Crock
2,400,321 A 5/1946 Troxell
2,449,851 A 9/1948 Jackson
2,453,510 A 11/1948 Jackson
2,492,431 A 12/1949 Kroeckel
2,584,459 A 2/1952 Jackson
2,599,330 A 6/1952 Jackson
2,651,980 A 9/1953 Wells et al.
2,746,367 A 5/1956 Ferguson
2,916,836 A 12/1959 Stewart et al.
3,067,656 A 12/1962 Gustaffsson
3,088,384 A 5/1963 Heer et al.
3,095,789 A 7/1963 Melvin et al.
3,130,653 A * 4/1964 Talbott ..... 404/112
3,147,678 A 9/1964 Lewis
3,262,378 A 7/1966 Schrimper et al.
3,396,642 A 8/1968 Martinson
3,403,609 A 10/1968 Bradshaw et al.
3,406,761 A 10/1968 Ryan
3,412,658 A 11/1968 Griffin
3,427,939 A 2/1969 Braff et al.
3,540,360 A 11/1970 Snow et al.
3,681,484 A 8/1972 McKie et al.
3,838,933 A 10/1974 Lehman et al.
3,850,541 A 11/1974 Baillet et al.
3,871,788 A 3/1975 Barsby
3,883,259 A 5/1975 Berg et al.
3,918,214 A 11/1975 Buschman
4,027,991 A 6/1977 Maass
4,043,694 A 8/1977 Mullen
4,224,003 A 9/1980 St. Louis
4,249,327 A 2/1981 Allen
4,256,416 A 3/1981 Bishop
4,314,773 A 2/1982 Allen
4,318,631 A 3/1982 Vickers
4,343,568 A * 8/1982 Kaltenegger ..... 404/133.1
4,349,295 A 9/1982 Morrison
4,359,296 A 11/1982 Cronkhite
4,371,287 A * 2/1983 Johansson ..... 404/84.5
4,375,351 A 3/1983 Allen
4,379,653 A 4/1983 Brown
4,386,901 A 6/1983 Morrison
4,388,018 A 6/1983 Boschung
4,408,978 A 10/1983 Owens
4,427,358 A 1/1984 Stilwell
4,431,336 A 2/1984 Nightengale et al.
4,449,845 A 5/1984 Carrillo
4,470,783 A 9/1984 Friebel et al.
4,499,779 A 2/1985 Maass
4,591,291 A 5/1986 Owens
4,614,486 A 9/1986 Bragagnini
4,641,995 A 2/1987 Owens
4,650,366 A 3/1987 Morrison
4,655,633 A 4/1987 Somero et al.
4,701,071 A 10/1987 Morrison
4,702,641 A 10/1987 Naser et al.
4,729,194 A 3/1988 Maier et al.
4,734,022 A 3/1988 Shimabukuro
4,740,348 A * 4/1988 Rose ..... 264/296
4,752,156 A 6/1988 Owens
4,775,306 A * 10/1988 Kikuchi et al. ..... 425/62
4,798,494 A 1/1989 Allen
4,838,730 A 6/1989 Owens
4,848,961 A 7/1989 Rouillard
4,856,932 A 8/1989 Kraft
4,861,188 A 8/1989 Rouillard
4,892,437 A 1/1990 Kraft
4,911,575 A 3/1990 Tidwell
4,930,935 A 6/1990 Quenzi et al.
5,016,319 A 5/1991 Stigen
5,039,249 A 8/1991 Hansen et al.
5,062,738 A 11/1991 Owens
5,080,525 A 1/1992 Bricher et al.
5,096,330 A 3/1992 Artzberger
5,129,803 A 7/1992 Nomura et al.
5,156,487 A 10/1992 Haid
5,190,401 A 3/1993 Wilson
5,234,283 A 8/1993 Adkins
5,244,305 A 9/1993 Lindley
5,279,501 A 1/1994 Shelly
5,288,166 A 2/1994 Allen et al.
5,328,295 A 7/1994 Allen
5,352,063 A 10/1994 Allen et al.
5,375,942 A 12/1994 Lindley et al.
5,540,519 A 7/1996 Weber
5,556,226 A 9/1996 Hohmann, Jr.
5,567,075 A 10/1996 Allen
5,676,489 A 10/1997 Willhoite
5,778,482 A 7/1998 Sbrigato
5,779,390 A 7/1998 Tuusinen
5,803,656 A 9/1998 Turck
5,807,022 A 9/1998 McCleary
5,857,803 A 1/1999 Davis et al.
5,924,819 A 7/1999 Breidenbach
5,984,571 A 11/1999 Owens
6,022,171 A 2/2000 Munoz
6,029,752 A 2/2000 Young
6,056,474 A 5/2000 Nolan
6,089,786 A * 7/2000 Allen et al. ..... 404/112
6,089,787 A 7/2000 Allen et al.
6,139,217 A 10/2000 Reuter
6,155,708 A 12/2000 Lindley
6,174,105 B1 1/2001 Holmes et al.
6,200,065 B1 3/2001 Eitzen
6,223,495 B1 5/2001 Shaw et al.
6,231,331 B1 5/2001 Lievers
6,238,135 B1 5/2001 Rower
6,264,397 B1 * 7/2001 Majewski ..... 404/112
D447,152 S 8/2001 Cunningham et al.
6,293,780 B1 9/2001 Rijkers
6,296,467 B1 10/2001 Rouillard
6,302,619 B2 10/2001 Fix
6,322,286 B1 11/2001 Rijkers
6,325,531 B1 12/2001 Lindley
6,336,769 B1 1/2002 Cincis et al.
6,394,639 B2 5/2002 Lindley
6,623,208 B2 9/2003 Quenzi et al.
6,685,390 B1 2/2004 Eitzen
6,695,532 B2 2/2004 Somero et al.
6,953,304 B2 10/2005 Quenzi et al.
6,976,805 B2 12/2005 Quenzi et al.
7,044,681 B2 5/2006 Quenzi et al.
7,121,762 B2 10/2006 Quenzi et al.
7,175,363 B2 2/2007 Quenzi et al.
7,195,423 B2 3/2007 Halonen et al.
7,320,558 B2 1/2008 Quenzi et al.
7,396,186 B2 7/2008 Quenzi et al.
7,407,339 B2 8/2008 Halonen et al.
7,491,011 B2 2/2009 Quenzi et al.
7,891,906 B2 2/2011 Quenzi et al.
2004/0109728 A1 6/2004 Rose
2007/0071553 A1 3/2007 Koba
2008/0031687 A1 * 2/2008 Frankeny ..... 404/84.1
2008/0267708 A1 10/2008 Quenzi et al.
2009/0175681 A1 7/2009 Pietila et al.

FOREIGN PATENT DOCUMENTS

CH 352485 4/1961
DE 42402 11/1965
DE 4138011 5/1993
EP 1312717 5/2003
FR 1417130 10/1965
FR 2644806 3/1989
GB 308423 3/1929
GB 819621 9/1959
JP 6306813 1/1994
RU 436125 11/1974
SE 176924 10/1961

* cited by examiner 10
12
14
16
18
20
20a
20b
22
24
26
40°
10°

CONCRETE FINISHING APPARATUS

CROSS REFERENCE TO RELATED APPLICATIONS

The present application is a continuation of U.S. patent application Ser. No. 12/394,271, filed Feb. 27, 2009, now U.S. Pat. No. 7,891,906, which claims benefit of U.S. provisional application Ser. No. 61/031,796, filed Feb. 27, 2008, which are hereby incorporated herein by reference in their entireties.

FIELD OF THE INVENTION

The present invention relates generally to an improvement in a concrete finishing, smoothing and/or leveling apparatus and, more particularly, to a new type of concrete smoothing and leveling apparatus which is operable on partially set-up concrete to increase the smoothness and levelness quality specification of the partially set-up concrete and therefore the final and cured concrete surface.

BACKGROUND OF THE INVENTION

There is a growing and consistent need in the concrete construction industry for increased quality close-tolerance, flat and level concrete floors and slabs whereby the finished working surfaces of the floors and slabs being constructed are as flat and level as is economically possible using typical construction methods and finishing procedures. A variety of buildings and structures having concrete floors and slabs-on-grade, as well as elevated multi-level buildings or structures can benefit from achieving an increased smoothness and levelness concrete floor quality specification at a relative minimal increase in labor and cost to the building contractor and the customer.

Concrete floors are specified, measured and compared within the concrete industry according to an accepted concrete floor profile specification and measurement standard. One of these specification standards is for floor flatness "FF" and another is for floor levelness "FL". These two specifications together are generally known and referred to within the concrete industry as the F-number system. The F-number system offers a repeatable method for measuring floor quality through statistical means known in the art. Further information about this system of measurement as can be found in published documents by the American Concrete Instituted (ACI) under ACI 117, "Tolerances for Concrete Construction and Material"; ACI 302, "Guide for Concrete Floors and Slab Construction"; and ASTM (American Society for Testing and Materials) E-1115 "Test Methods for Determining Floor Flatness Using the F-Number System", where the details of each are incorporated herein by reference. For example, concrete floor surfaces having floor flatness specifications (FF) of between FF 15 and FF 25 and a floor levelness specification (FL) of between FL 15 and FL 25 are typical of hand screeded and finished concrete using typical manual hand tools and methods. At an increased level of floor flatness (FF) and floor levelness (FL), specifications between FF 50 and FF 80 and a floor levelness (FL) specification of between FL 50 and FL 80 are typical of close-tolerance upper-level-of-quality floors that are often desired in many building or structural applications but may not be especially easy or inexpensive to achieve. At an even higher level on the scale of quality, floor flatness (FF) specifications of between FF 80 and FF 100 and a floor levelness (FL) specification of between FL 80 and FL 100 are typical of very close-tolerance high-quality concrete floors and surfaces. These are often referred to in the industry as "super-flat floors" or simply "super flats". The equipment and methods used to achieve the higher and highest levels of quality may be typical of using automated laser-guided concrete screeding machines, such as the Somero LASER SCREED™ machines, such as described in U.S. Pat. Nos. 4,655,633; 4,939,935; 6,976,805; and 6,953,304 (which are hereby incorporated herein by reference in their entireties) and manufactured by Somero Enterprises of Houghton, Mich., USA, and in addition with considerable, effort, labor and skill necessary during the final concrete surface finishing operations.

High quality and super-flat concrete floors are typically much more difficult and expensive to consistently achieve than those conventionally produced. In order to achieve a higher level quality leading up to and including super-flat floors, work crews must be skilled, along with substantial level of experience and/or a high degree of training, and special equipment is often used to get the desired results. Placement and striking-off of uncured concrete to a specified grade for a conventional concrete floor or surface can be performed using hand tools; however, laser-guided machines are preferred since they are faster and much more accurate. Other special application tools and equipment, such as highway straight edges, power trowels, pan machines and double trowels, may be used separately, at the same time, or in combination with one another, during the various steps of the finishing process. A relatively large number of skilled workers are required to accurately finish a large floor for example, and production speed of the floor can be relatively slow with conventional processes, tools, and equipment. Additionally, as skilled workers and operators continue to work with the manual tools and finishing machine devices, such as hand and powered concrete trowels, pan machines and scrapers, for a long period of time, the laborers will tend to tire and fatigue as the job progresses, which can have an adverse affect on the final F-numbers and level of quality of the concrete floor or surface.

Some concrete leveling applications have implemented a spinning tube apparatus or the like, for constructing a concrete floors and surfaces. However, such spinning tube applications are typically implemented as an initial strike-off tool, such as a screed for striking-off or screeding freshly placed and uncured concrete to the desired grade. These tube type roller screeds are necessarily supported on some type of preset forms or screed rails to maintain grade height. Because these screeding devices are applicable only to freshly poured, uncured concrete, and the use of accurately set forms or guide rails implementation of such devices does not easily result in a close-tolerance or super-flat concrete floor surface. The additional manual processes still have to be performed on the surface after the initial screeding operation is completed, and after the concrete is at least partially set-up and beginning to cure, in order to obtain such a high quality or that approaching a super-flat concrete floor surface.

For the purposes of reference, a concrete machine and method for smoothing and flattening partially cured concrete to a close-tolerance surface that uses spinning rollers is disclosed in U.S. Pat. No. 6,695,532, issued Feb. 24, 2004 to Somero et al. This machine incorporates a movable unit which is movable and supportable over partially cured concrete and is generally supported by wheels or tracks upon the surface of the partially-cured concrete. Two cylindrical and rotatable finishing members or rollers having a longitudinal axis are attached to opposite ends of the machine and used to engage the surface of the partially-cured concrete. The elevations of the each of the cylindrical finishing rollers are adjustable and are controlled by a laser control system. The cylindrical finishing rollers are able to be rotated opposite to the direction of travel of the machine as the unit moves in a first or second direction of travel.

Therefore, there is a need in the industry to increase flatness and levelness quality, while reducing time, effort, cost and necessary skill levels required for creating and finishing high quality concrete surfaces with typically known concrete related procedures and methods.

SUMMARY OF THE INVENTION

The present invention is intended to provide a concrete floor or surface finishing apparatus which is operable to finish a surface of a partially set-up concrete slab or floor to a higher degree-flatness and smoothness than is currently available using known or conventional methods. The apparatus of the present invention requires minimal manual labor processes to achieve the desired floor surface quality. Additionally, the apparatus of the present invention is applicable to large floors and surface areas, whereby the entire floor surface can achieve the desired high level of quality with little extra relative effort or cost.

According to an aspect of the present invention, a concrete finishing apparatus for smoothing and leveling partially set-up concrete at a support surface includes a movable unit, and one set of rotating blades at the base of the unit for engagement of a partially set-up concrete surface, and at least one rotatable ring working member or element loosely mounted at the outer periphery of the movable unit. The movable unit is movable and supported over and/or on the partially set-up concrete and may be movable in a plurality of desired directions. The rotatable ring engages the partially set-up concrete surface and rotates to work or process or finish the partially set-up concrete surface.

In one form, the at least one rotatable ring working member may comprise a single ring that is installed on a machine (such as, for example, a typical concrete power trowelling machine that is well known within the concrete construction industry). The single rotatable ring working member may be attached to the outer portions of the rotating trowelling blades at the internal diameter of the ring. Thus, the addition of the single rotatable ring working member may encompass the rotating blades of the power trowelling machine and increases the effective overall diameter of the machine, as well as the surface contact surface area of engagement with the concrete.

In another form, the concrete finishing apparatus may include at least two rotatable ring working members mounted at the outer periphery of the movable unit. Rather than only using a single rotatable ring working member rotating in a single direction and in unison with a set of rotating blades, such a two ring configuration provides a first rotatable ring working member driven in either direction relative to the rotation of the blades, and a second rotatable ring working member (of a larger diameter than the first and concentrically and additionally added to the outside perimeter of the first rotatable ring member) driven in a direction opposite the direction of rotation of the first ring. With such a configuration, the average resultant torque reaction at the handlebars of a walk behind concrete power trowelling machine may be substantially reduced or limited. The second ring also provides the advantages of further increasing the working surface contact area of the machine, and therefore further improves both the productivity machine and the resulting quality of the concrete surface.

According to another aspect of the present invention, a concrete finishing apparatus for smoothing and leveling partially set-up concrete at a support surface includes a movable unit and two sets of rotating blades at the base of the unit for engagement of a partially set-up concrete surface, and at least one (or optionally two or more) rotatable ring working members loosely mounted at the outer periphery of the movable unit. A power trowelling machine with two sets of rotating blades at the base of the unit allows the operator to be positioned on the "ride-on" machine itself while in operation as opposed to the walk behind version.

The ring member may be driven by a separate drive device or actuator or motor (such as a hydraulic motor or the like), and thus may be driven independently from the driving of the blades of the movable unit. Optionally, and as discussed above, the machine may include two rings, with one ring driven in one direction and the other ring driven in the opposite direction. Optionally, the rotatable inner and outer ring members may be driven at various speeds that are independent of the rotational speed of the two blade assemblies. Such a design feature provides the further advantages of independent drives and operator-selective variable speed control of the separate blade assemblies and the rotating ring concrete finishing members.

Therefore, the present invention provides a concrete smoothing and leveling apparatus which is capable of finishing a concrete floor or surface to a higher degree of quality while being used and incorporated with the current methods and practices of concrete construction. This emerging state-of-the-art apparatus requires reduced or minimal manual labor processes, few or no additional or new concrete finishing steps, and is inexpensive to operate as compared to existing concrete finishing process machinery and devices.

These and other objects, advantages, purposes and features of the present invention will become apparent upon review of the following specification in conjunction with the drawings.

DESCRIPTION OF THE PREFERRED EMBODIMENTS

Figures 1, 1A:
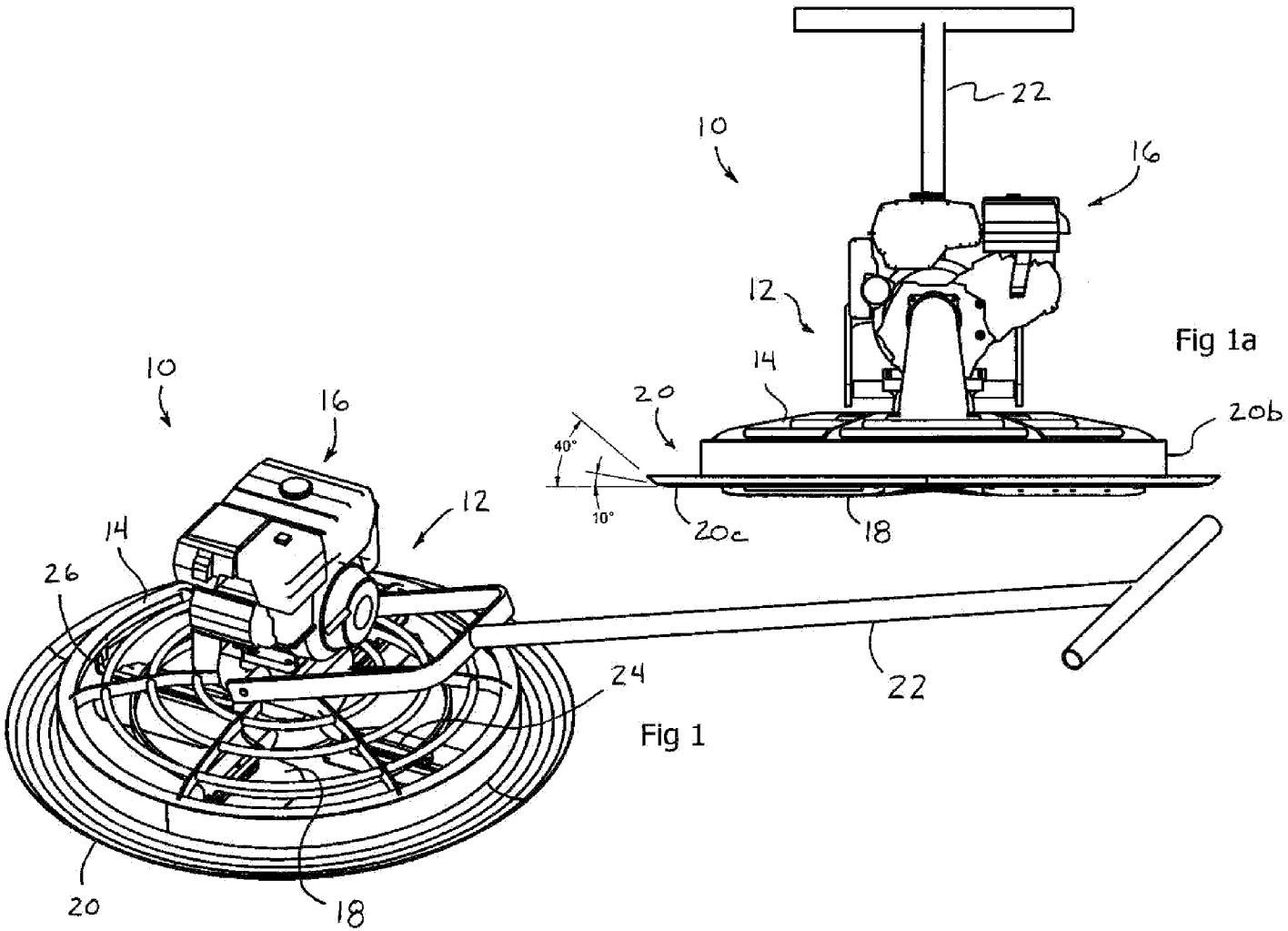
FIG. 1 is a perspective view of a concrete finishing apparatus for smoothing and leveling partially set-up concrete at a support surface in accordance with the present invention.
FIG. 1A is a front elevation of the concrete finishing apparatus of FIG. 1.

Referring now specifically to the drawings and the illustrative embodiments depicted therein, a concrete finishing apparatus 10 for smoothing and leveling partially set-up concrete at a support surface includes a movable unit 12 having a frame portion 14, a driving device or drive motor or power source or drive means 16 supported on the frame portion, with a set of rotating blades 18 disposed at the base of the unit for engagement of a partially set-up concrete surface and rotatably driven by the driving device 16, and at least one rotatable ring working member 20 disposed at or mounted at the outer periphery of the movable unit (FIG. 1). The movable unit 12 is movable and supported over and/or on the partially set-up concrete and may be movable in a plurality of desired directions, such as via an operator moving the unit by pushing or pulling at a handle 22. The blades 18 may be rotatably driven about their central axis via the driving device 16, while the rotatable ring working member 20 is rotatably driven with the blades and in the same direction as the blades 18 and about its central axis to movably engage the partially set-up concrete surface to provide enhanced finishing of the partially set-up concrete surface, as discussed below.

The frame portion 14 and driving device 16 and blades 18 may be similar in construction and operation as similar components used in known power trowel devices. For example, the driving device 16 may comprise a gas-powered engine or other suitable device or driving means that is supported on the frame portion 14 and is operable to rotate the blades about their generally central and generally vertical axis of rotation when activated. The frame portion provides a cage or cover that substantially encases or encompasses the blades to limit or substantially preclude an operator from contacting the blades during operation of the device. The movable unit 12 may include user actuatable controls (such as at the handle 22 or the like) to allow an operator to control the rotation of the blades 18 and/or to control or adjust the rotational speed of the blades relative to the frame portion during operation of the device.

In the illustrated embodiment, the blades 18 comprise generally flat blades or panels that are mounted to the underside of respective arms or bars 24 extending radially outward from a drive shaft of the driving device 16 such that the blades are rotated in response to operation of the driving device 16. The rotatable ring working member 20 is disposed at and encompasses the outer ends of the blades 18 and/or arms 24 and is movable with the arms to rotate about its generally central axis of rotation. Thus, actuation of the driving device 16 imparts rotation of the blades and the rotatable ring working member about their co-axial axes of rotation to work and smooth the concrete surface.

In its most basic form, the single rotatable ring working member 20 that may be installed on a typical concrete power trowelling machine, such as a power trowel of the types that are known within the concrete construction industry. The single rotatable ring working member is of such an overall diameter, internal diameter, and cross section that the ring member is able to be attached to the outer portions of the rotating trowelling blades at the internal diameter of the ring. Thus the addition of the single rotatable ring working member fully encompass the rotating blades of the power trowelling machine and greatly increases the effective overall diameter of the machine as well as the surface contact surface area of engagement with the concrete.

Figure 2:
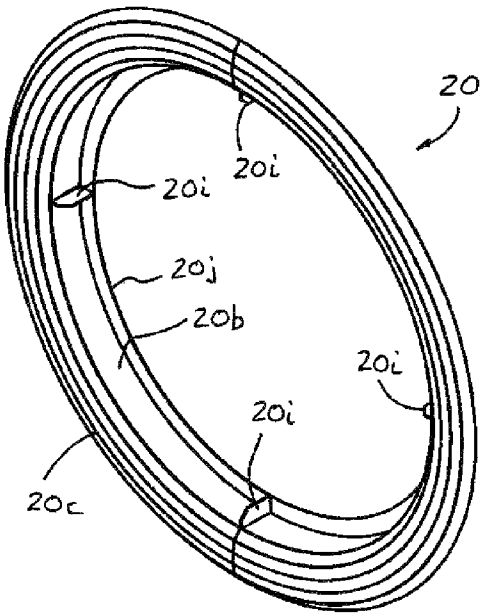
FIG. 2 is a perspective view of the rotatable ring working member or assembly of the concrete finishing apparatus of FIGS. 1 and 1A.
Figure 2C:
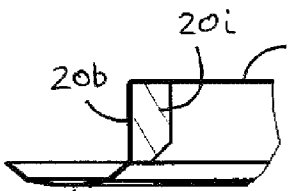
FIG. 2C is an enlarged view of the region C in FIG. 2B.
Figure 2B:
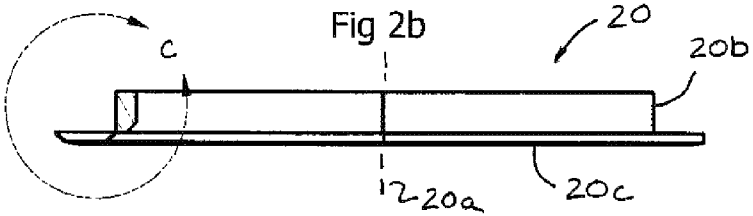
FIG. 2B is a sectional view of the rotation ring working member or assembly taken along the line B-B in FIG. 2A.
Figure 2A:
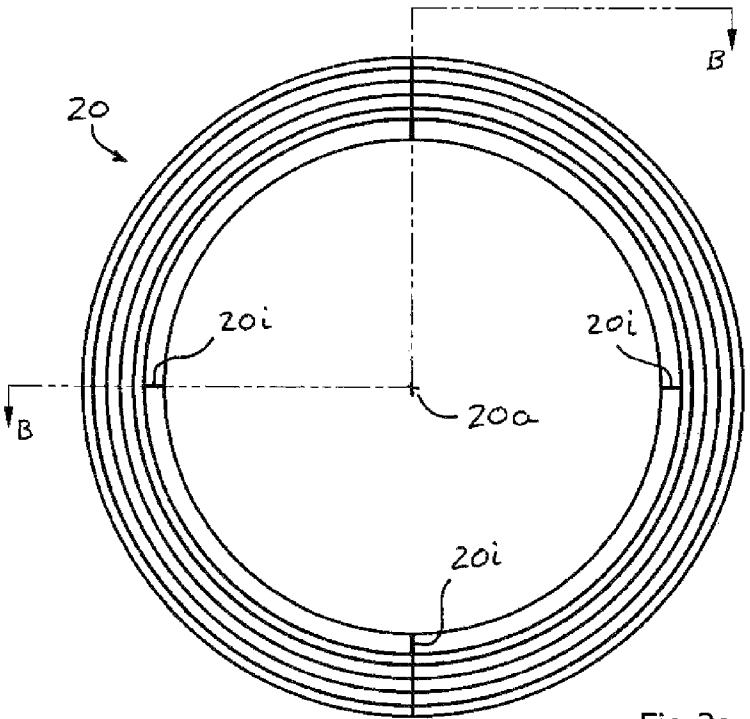
FIG. 2A is a bottom view of the rotatable ring working member or assembly of FIG. 2.
Figure 3:
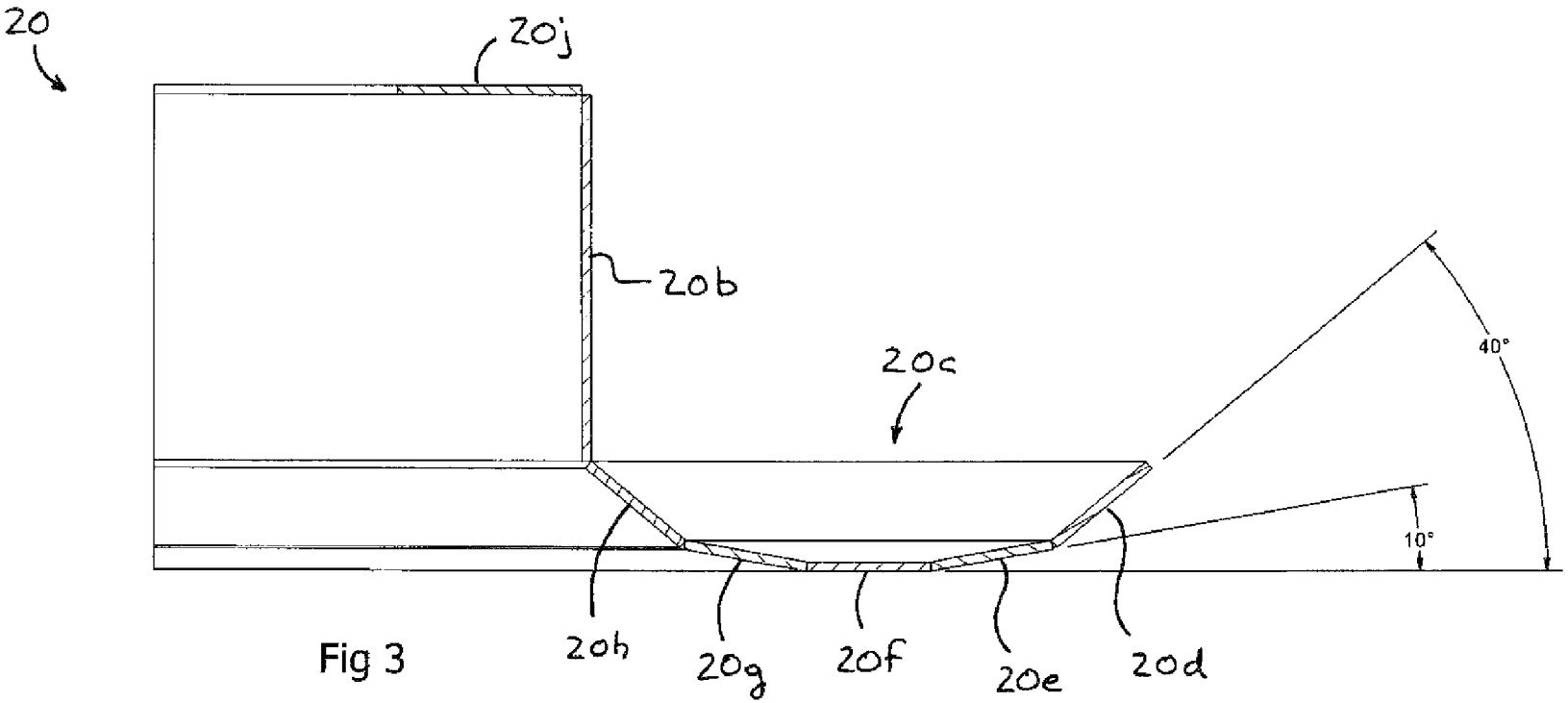
FIG. 3 is another enlarged sectional view of the rotational ring working member or assembly of FIGS. 2 and 2A.

The rotatable ring working member 20 is a generally horizontal oriented ring-shaped structure or member, having a single central axis 20*a* of rotation whereby the axis of rotation is generally vertical and perpendicular with respect to the surface of the concrete and the like (FIGS. 2, 2A, and 2B). The rotatable ring working member includes a generally continuous profiled surface for contact and engagement with the partially set-up concrete surface. As shown in FIG. 3, a cross-section of the rotatable ring working member, as established by an imaginary plane that is coincident with the central axis of rotation, exhibits a profile shape that defines a surface for contact and engagement with the partially set-up concrete surface. In the illustrated embodiment, the rotatable ring working member 20 includes an inner wall 20*b* and a lower working surface 20*c*. The profile shape of the working surface 20*c* of the rotatable ring may be generally defined and include for example, a first angle of attack surface 20*d*, a second angle of attack surface 20*e*, a horizontal working surface 20*f*, a first angle of departure surface 20*g*, and a second angle of departure surface 20*h*, all smoothly joined to form a generally smooth and continuous concrete working surface profile. Optionally, the structural rigidity of the rotatable ring may be enhanced, such as via use of a substantially rigid material, such as steel or the like, or such as via use of a boxed section or member or rib within and/or around the ring or such as via any other suitable stiffening means to limit or reduce flexing of the ring during operation of the machine. The design and material of the ring may be selected to provide the desired strength and rigidity without increasing the weight of the ring to a point where the ring may possibly add too much downpressure to the surface of the concrete since the ring is generally free-floating on or is generally supported on the concrete surface relative to the rest of the machine during operation.

With the generally smooth and continuous concrete working surface profile thus defined, and the profile then revolved or swept around the central axis of rotation and at a given radial distance from the central axis of rotation, a continuous concrete working surface or member in the shape of a ring is thus defined and created. The ring-shaped concrete working surface or member can generally be of any desired diameter, while the cross-sectional size of the profile of the ring may vary in proportion to the diameter such that for a given ring diameter, and various particular ring designs might include cross-sectional dimensions ranging from thin to thicker proportions as compared to the overall diameter as may be preferred. Within the general size limitations of the apparatus, the larger the overall diameter of the rotatable ring working member, the more likely it will be able to produce the desired high level of flatness and smoothness quality of the concrete surface.

In the illustrated embodiment, the rotatable ring working member 20 comprises a floating ring that is loosely disposed at the outer ends of the blades, such as at outer ends of a plurality of ring drive bars 26 extending radially outward from the outer ends of the blades 18 and/or arms 24. As can be seen with reference to FIG. 1, the inner wall 20*b* generally abuts or is located at or near the outer ends of the drive bars 26 and includes a plurality of engaging tabs 20*i* (FIG. 2) extending radially inward from the inner wall 20*b*, whereby the drive bars 26 engage the tabs 20*i* to impart rotational movement of the rotatable ring working member 20 when the driving device is activated to rotate the arms 24 and blades 18. The inner wall 20*b* allows for vertical movement of the rotatable ring working member 20 relative to the drive bars 26 so that the rotatable ring working member 20 is supported on the concrete surface and generally floats on the concrete surface. The rotatable ring working member 20 includes an upper lip or wall 20*j* to limit downward movement of the rotatable ring working member 20 relative to the drive bars 26.

Typical concrete power trowel machines include a plurality of toweling blades that are rotatably driven at various speeds by a power source such as an internal combustion engine. The machine is controlled by an operator who maintains control of the unit through a set of handlebars as the operator stands or walks along with the machine. With this configuration, these types of machines are generally known in the industry as walk behind concrete power trowels. The overall diameter of the walk behind power trowel rotating blades may typically range from 24 to 54 inches (60 to 137 cm) and larger. The multiple rotating blades for engagement with the partially-cured concrete surface are generally and readily adjustable with respect to their angle of attack relative to the concrete surface as desired by the operator. The angle of attack of the blades is thus adjusted together in unison depending upon the desired results and the specific concrete surface finishing operation underway. Generally, blades that are held in a flat position or providing a very minimal angle of attack are used when concrete surface floating operations are underway. Concrete floating operations are used to accomplish several primary tasks including, for example: (1) to embed larger aggregate just below the surface, (2) to reduce or eliminate imperfections, bumps, and voids in the concrete surface, (3) to help compact the concrete and consolidate the mortar at the surface in anticipation of further finishing operations (such as finish trowelling), and/or (4) to open the surface of the concrete which may have started to crust over before the remaining finishing operations have begun. When the blades are adjusted to progressively more aggressive angles of attack relative to the concrete surface, such angle settings are consistent with a series of typical final trowelling operations.

Optionally, the concrete power trowel may be fitted with different sets of blades as desired for a more a specific operation. For example, wider blades that are about 10 inches (about 25 cm) wide are mainly used for floating operations, while narrower finishing blades that are about 6 inches (about 15 cm) wide are used for trowelling and finishing operations after floating operations are complete. Combination blades that are about 8 inches (about 20 cm) wide can provide both floating and finish trowelling capabilities in one blade. To provide both floating and finishing characteristics the combination blades have a leading edge that is slightly pitched upward allowing concrete to flow below the flattened blade for floating operations, while the trailing edge is straight and square to provide finish trowelling capabilities when the blades are aggressively angled.

As a further option, concrete power trowel blades can be replaced with pan floats, float disks, or simply pans. These are circular metal disks having an overall diameter matching the overall diameter of the rotating blades. The outer edge of the pan is turned upward along its periphery to allow concrete to pass under it. The underside and contact face of the pan can be either flat or slightly convex relative to the concrete surface. Pans, like the wider float blades, are used specifically for concrete floating operations. The advantages of using pans are that they can generally increase the productivity of the machine during floating operations. An increase in contact surface area of a pan reduces the contact pressure of the machine on the surface of the concrete as compared to blades, and because they are generally flatter than blades, the accuracy and flatness of the concrete surface can be generally improved.

As stated above, the addition of the single rotatable ring working member added to a typical concrete power trowelling machine greatly increases the effective overall diameter of the machine as well as the contact surface area of engagement with the concrete. In the illustrated embodiment, the single rotatable working ring is rotatably driven by the blade arms. Thus, during floating operations, the blades and the rotatable ring working member rotate in unison about their co-axial axes of rotation. The rotatable working ring however is able to float freely in a vertical direction relative to the rotating blade arms and the blades while in contact with the surface of the concrete. The further advantage of this is that it the rotatable working ring is able to freely ride up and over any bumps or high areas that may be present in the surface of the concrete. As the machine progresses along in any direction over the concrete surface, the contact surface of the ring tends to cut down and reduce any bumps and high areas. In similar fashion, the frictional contact between the concrete and the rotatable working ring tends to transport and carry along any of the extra material (concrete paste, sand, and small aggregate) from the bumps and high areas to then fill any holes or low areas that may be present in the surface. This inherent leveling action along with the increased overall effective diameter of the machine, provides a significant increase in the productivity of the machine, and an overall increase in the flatness and levelness quality capabilities provided by a typical walk behind concrete power trowel. Thus, the addition of the floating rotatable ring working member to a walk behind concrete power trowel provides increased productivity and increased concrete surface quality without the added cost of an additional process step, finishing operation, or any significant required increase in skill level by the operator.

One potential disadvantage of the above described embodiment of this invention is that the addition of the rotatable working ring tends to increase the torque reaction of the rotating blades and working ring at the operator's handlebars. The operator will be required to hold onto the machine's handlebars more tightly due to the tendency of the handlebar to rotate when the driving device is operated. A longer handlebar design can help offset the increased torque reaction experienced by the operator; however, providing a pair of oppositely rotating rings may substantially reduce the torque reaction at the handlebars, as discussed below.

Figure 4:
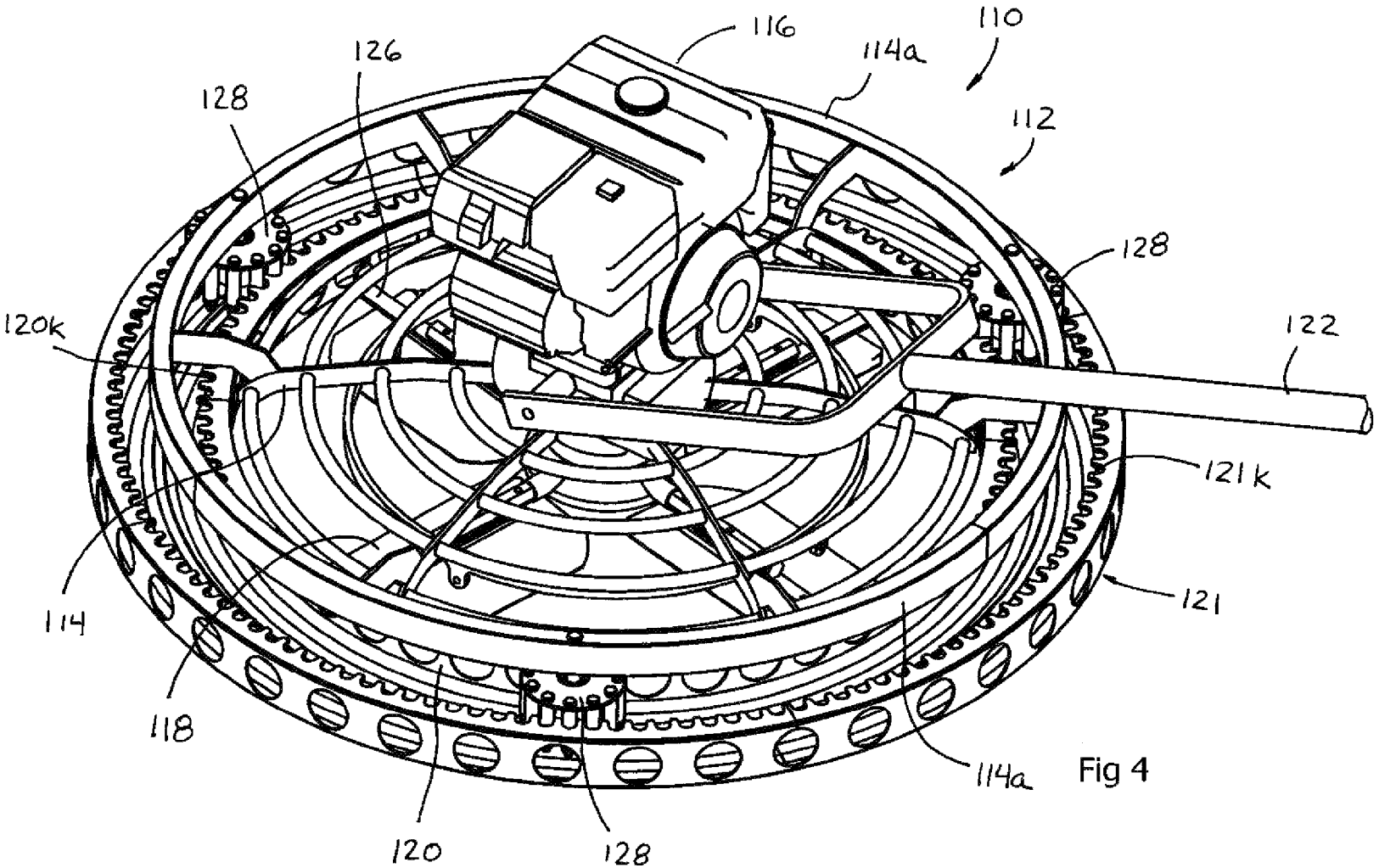
FIG. 4 is a perspective view of another concrete finishing apparatus for smoothing and leveling partially set-up concrete at a support surface in accordance with the present invention.

Referring now to FIG. 4, a concrete finishing apparatus 110 for smoothing and leveling partially set-up concrete at a support surface includes a movable unit 112 having a frame portion 114, a driving device or drive motor or power source or drive means 116 supported on the frame portion, with a set of rotating blades 118 disposed at the base of the unit for engagement of a partially set-up concrete surface and rotatably driven by the driving device 116, and at least two rotatable ring working members 120, 121 mounted at the outer periphery of the movable unit. The movable unit 112 is movable and supported over and/or on the partially set-up concrete and may be movable in a plurality of desired directions, such as via an operator moving the unit by pushing or pulling at a handle 122. The blades 118 may be rotatably driven about their central axis via the driving device 116, while the rotatable ring working members 120, 121 are rotatably driven with one of the working members rotating in the same direction as the blades and the other working member rotating in an opposite direction from the blades and about their central axes to movably engage the partially set-up concrete surface to provide enhanced finishing of the partially set-up concrete surface.

Rather than only using a single rotatable ring working member rotating in a single direction and in unison with a set of rotating blades, concrete finishing apparatus 110 includes the first or inner rotatable ring working member 120 that is able to be driven in either direction relative to the rotation of the blades (such as in the same direction as the blades), and the second or outer rotatable ring working member 121 of a larger diameter than the first and concentrically and additionally disposed to the outside perimeter of the first rotatable ring member 120. The second ring is operable to be driven in a direction opposite the direction of rotation of the first ring, as discussed below. Concrete finishing apparatus 110 may be otherwise similar to concrete finishing apparatus 10, discussed above, such that a detailed discussion of the devices need not be repeated herein.

In the illustrated embodiment, frame portion 114 includes an upper frame member 114*a* that extends over the rotatable ring working members 120, 121, and that supports a plurality planetary gears 128 (such as three as shown in FIG. 4 or more or less depending on the particular application) that are rotatably attached to the upper frame member 114*a*. The planetary gears 128 engage an outer toothed or cogged surface 120*k* of inner rotatable ring working member 120 and an inner toothed or cogged surface 121*k* of outer rotatable ring working member 121. In the illustrated embodiment, inner ring member 120 is connected to or engaged by the drive bars 126 of blades 118 and arms 124 and is rotatably driven via rotation of the blades 118 by the driving device 116, such as in a similar manner as described above (and the inner ring member may be vertically movable relative to the blades and drive bars such as in a similar manner as described above). The outer rotatable ring working member 121 is driven by the engagement of the gear wheels or planetary gears 128 rotatably mounted to the stationary ring member or upper frame member 114*a* of the support structure or frame portion 114 of the apparatus 110.

The cogs or gear teeth cut into the surfaces 120*k*, 121*k* of the respective inner and outer rotatable ring working members 120, 121 engage a series of drive pins or teeth of each of the gear wheels 128. In this way, as the inner ring 120 and blades 118 are rotatably driven, the outer ring is rotatably driven in the opposite direction and at nearly the same speed (a slight speed difference may result as the inner and outer rotating ring members each have different diameters and circumferences and thus a different number of cogs or gear teeth). As with the single ring device or apparatus 10, discussed above, both rings 120, 121 of apparatus 110 may be free to move or otherwise float in a generally vertical direction with respect to the support structure of the machine, the rotating blades, and the surface of the concrete. Such vertical movement may be facilitated by the teeth or cogs of surfaces 120*k*, 121*k* sliding generally vertically along the gear pins of the gear wheels or planetary gears 128. Thus, by providing opposite rotating ring members that engage the concrete surface, the average resultant torque reaction at the handlebars of a walk behind concrete power trowelling machine can be greatly reduced and essentially eliminated. The second ring offers the further advantages of further increasing the working surface contact area of the machine, and therefore further improves both the productivity machine and the resulting quality of the concrete surface.

Optionally, it is envisioned that the concrete finishing apparatus or machine may be responsive to a laser leveling or laser control system that is operable to control or adjust the elevation of the rotatable ring or rings relative to the frame portion and blades during operation of the apparatus. For example, the apparatus may include two or more (such as, for example, three) laser receivers at the rotatable ring (such as mounted to masts or support rods extending upward from the rotatable ring). The laser receivers may detect a laser plane generated by a laser plane generating device at the support surface, and may be used with an elevation control system to control the elevation of the rotatable ring, such as by adjusting the down pressure or level of the rotatable ring relative to the frame portion, such as via three independently controlled linear actuators, such as a linear actuator at or near each of the planetary gears that support the frame portion and blades relative to the outer ring. This would allow the ring to be held at the desired grade elevation relative to the power trowel's spinning blades.

With such a laser control system, the concrete finishing apparatus may provide enhanced surface quality by maintaining the rings at an appropriate level or grade and adjusting a down pressure of the rings relative to the blades to maintain the rings at the desired or appropriate or selected level or grade. The relative sizing of the blades and rings, along with the design or form of the contact surfaces, and proportional weights of the spinning blades and rings may be selected to provide the desired results. Likewise, the control system may be adjusted to provide the desired results depending on the particular application of the apparatus on different concrete types and conditions.

Optionally, it is envisioned that in some applications, such as where the weight of the rings is increased, the apparatus may include a means for providing an upwardly directed force to counteract any excess ring weight or otherwise effectively adjust the down pressure of the rings. For example, adjustable linear coil springs or air springs or the like in combination with the linear actuators that control the ring elevation may provide advantages for controlling the ring down pressure.

Thus, and particularly for any given smaller areas of concrete relative the overall diameter of the outer ring, a laser-guided elevation control may provide enhanced performance of the apparatus and may provide minor corrections to the concrete elevation. The apparatus thus may provide improved or enhanced accuracy of a finished concrete floor or surface.

During operation, the apparatus is substantially supported by the spinning blades while the spinning ring simply floats on the concrete surface in an effort to generally average-out or even-out the existing surface imperfections, and the outer ring is the last thing in contact with the concrete surface as the apparatus or machine advances. In order to provide enhanced control of the elevation of the outer ring, the laser control system may control the elevation of at least the outer ring by small amounts relative to the central blades. Optionally, it is envisioned that the apparatus may control the relative pitch or angle of attack of the ring relative to the spinning blades with respect to the speed and direction of travel of the machine over the surface. The apparatus may include any suitable or appropriate electronic sensors, computerized controls, and software and/or circuitry to accomplish such tasks for the operator, and optionally the apparatus may automatically accomplish such tasks or may accomplish such tasks responsive to a user or operator input.

Typically, if the concrete floor or surface is placed and leveled using a laser-controlled laser screeding device, such as a Somero LASER SCREED™, any necessary or desired elevation corrections to the concrete surface should be relatively small, since the overall levelness of the floor or surface should already be accurate. Any necessary elevation corrections would thus likely be relatively small and limited to minor defects in proportion to the overall diameter of the outer spinning ring. A concrete finishing apparatus as described above that includes laser receivers and an elevation control system may offer advantages in an enhanced capability of the machine to effectively improve the accuracy of the finished concrete floor or surface.

Figure 5:
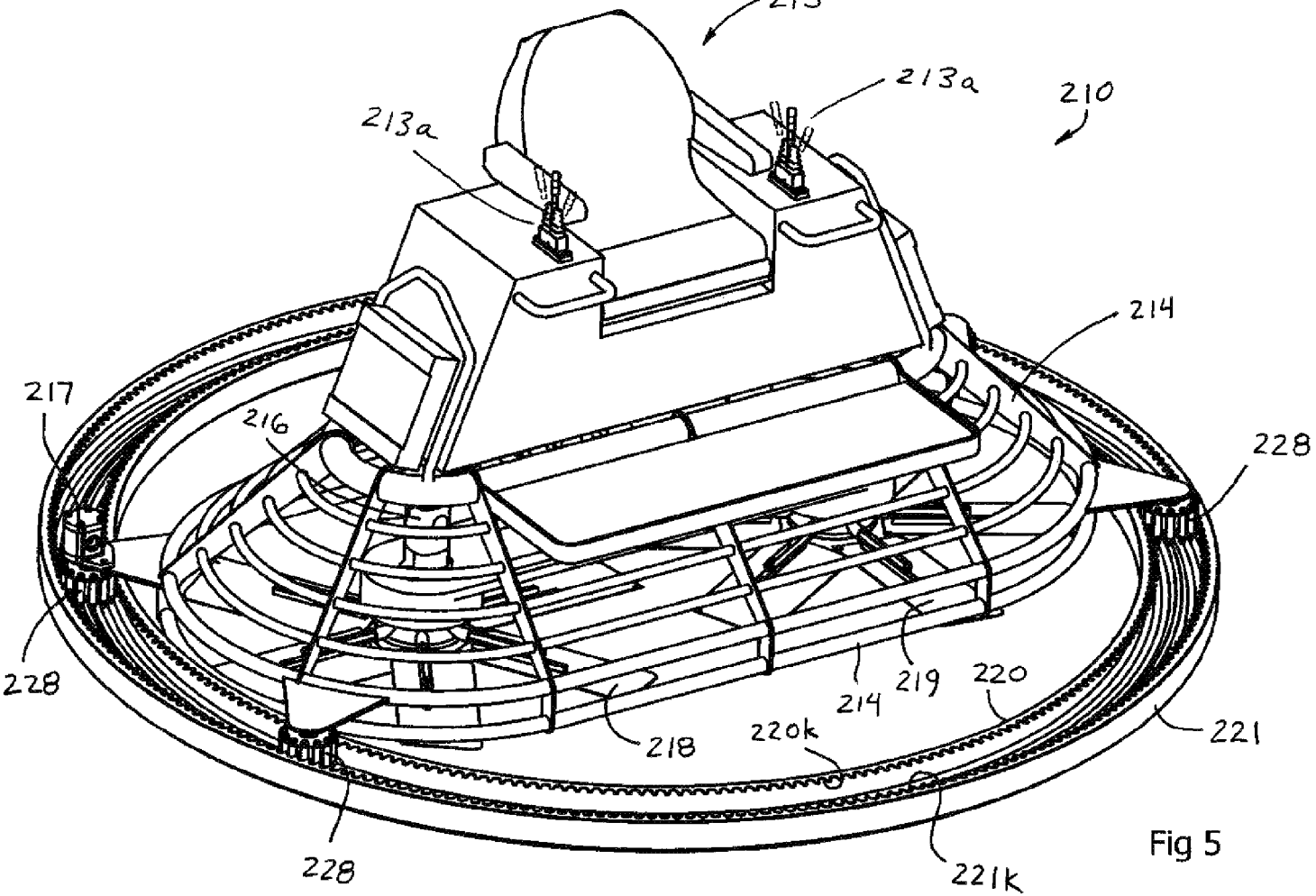
FIG. 5 is a perspective view of another concrete finishing apparatus for smoothing and leveling partially set-up concrete at a support surface in accordance with the present invention.
Figure 6A:
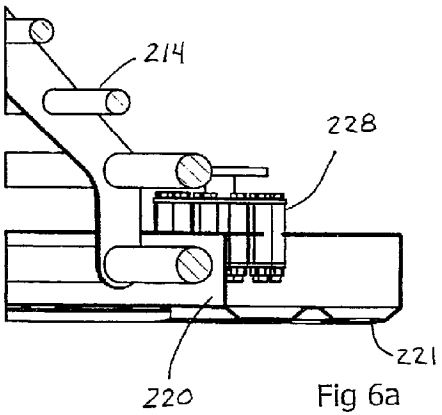
FIG. 6A is a sectional view of the concrete finishing apparatus taken along the line A-A in FIG. 6.
Figure 6:
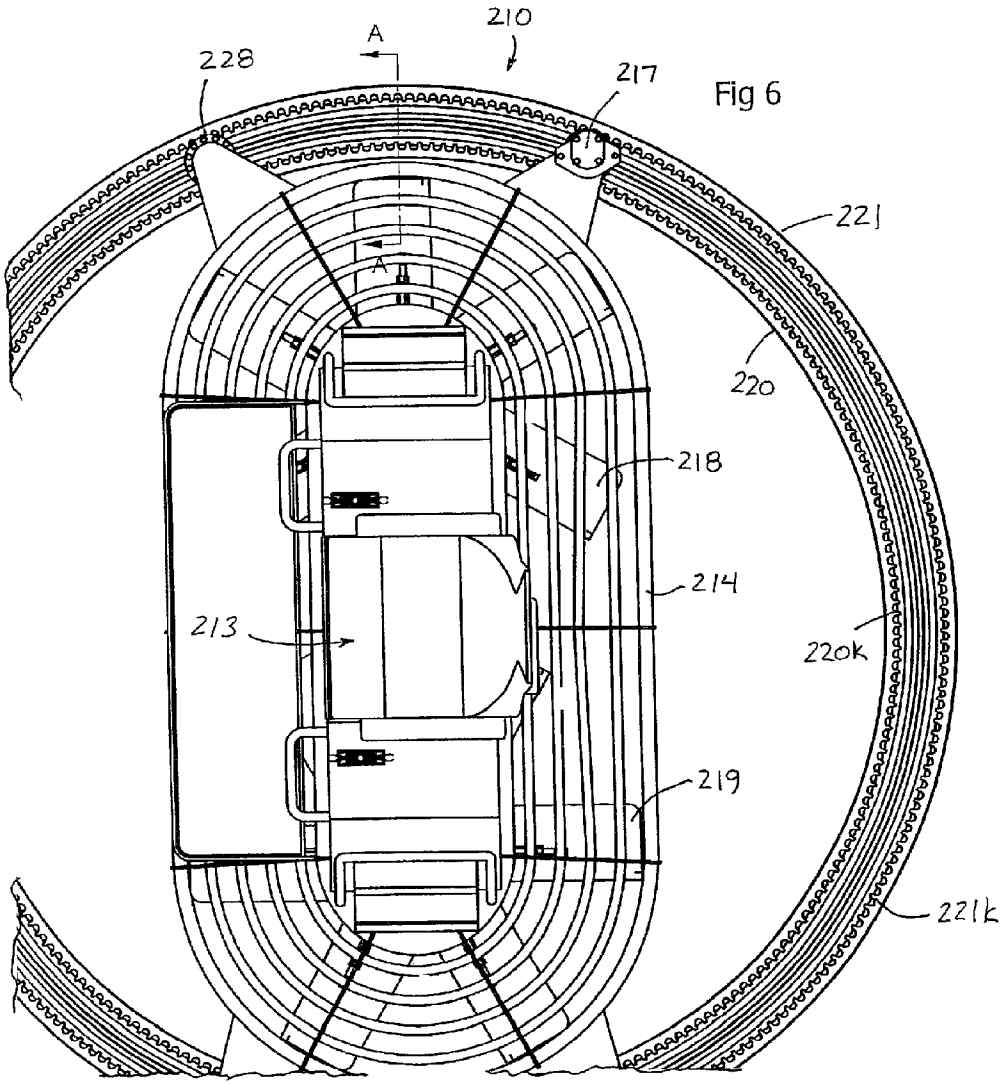
FIG. 6 is a portion of a top view of the concrete finishing apparatus of FIG. 5.

Optionally, the concrete finishing apparatus of the present invention may comprise a ride-on construction that allows an operator to ride the apparatus during operation of the concrete finishing apparatus. For example, and with reference to FIGS. 5, 6 and 6A, a concrete finishing apparatus 210 for smoothing and leveling partially set-up concrete at a support surface includes a movable unit 212 having a frame portion 214, a driving device or drive motor or power source or drive means 216 supported on the frame portion, with two sets of rotating blades 218, 219 disposed at the base of the unit for engagement of a partially set-up concrete surface and rotatably driven by the driving device 216, and at least two rotatable ring working members 220, 221 mounted at the outer periphery of the movable unit. The movable unit 212 is movable and supported over and/or on the partially set-up concrete and may be movable in a plurality of desired directions. The blades 218, 219 may be rotatably driven about their respective central axes via the driving device or devices 216 (such as one or more driving devices or motors, such as a hydraulic motor operable to rotatably drive a respect set of blades), while the rotatable ring working members 220, 221 are rotatably driven with one of the working members rotating in the same direction as the blades and the other working member rotating in an opposite direction from the blades and about their central axes to movably engage the partially set-up concrete surface to provide enhanced finishing of the partially set-up concrete surface.

The power trowelling machine or unit, with two sets of rotating blades at the base of the unit, allows the operator to be positioned on the machine itself (such as at an operator station or seat 213) while in operation as opposed to the walk behind version, discussed above. Such types of power trowelling machines are known in the concrete construction industry as "ride-on" power trowels. These machines are typically subject to the same selections of rotating blade options as the walk behind machines, such as, for example, floating, trowelling, and combination blades as well as the option of pan floats, float disks, or simply pans. The operator station 213 may include one or more user inputs or controls 213*a*, such as levers or switches or other user actuatable controls or inputs, for the operator to actuate or adjust to operate and control the machine, such as to control the motors of the blades and/or rings. Optionally, the concrete working apparatus 210 may be driven or steered via tilting or raising/lowering the ring members relative to one another, such as discussed below.

Similar to apparatus 110, discussed above, apparatus 210 includes a plurality of gear wheels or planetary gears 228 rotatably mounted to an upper frame member 214*a* of frame portion 214 that extends over the rotatable ring working members 220, 221. In the illustrated embodiment, there are four planetary gears 228 at the respective corners of the frame portion 214. Each planetary gear 228 engages the outer toothed or cogged surface 220*k* of inner rotatable ring working member 220 and an inner toothed or cogged surface 221*k* of outer rotatable ring working member 221. The inner and outer working members 220, 221 are loosely disposed at the outer periphery of the unit and are not attached to or engaged with the blades 218, 219. Instead, the inner and outer working members 220, 221 are driven via a drive motor or driving device 217 that is operable to rotatably drive one (or two or more) of the planetary gears 228, whereby rotation of the driven planetary gear 228 imparts a rotation of one of the working members 220, 221 in one direction and a rotation of the other of the working members 220, 221 in the opposite direction.

For example, and in similar fashion to apparatus 110, discussed above, cogs or gear teeth are cut or formed or established at or on or into the surfaces of the respective inner and outer rotatable ring working members and engage a series of drive pins or teeth of each of the gear wheels. In this way, as the driven gear wheel is rotatably driven, the inner ring is rotatably driven in one direction and the outer ring is rotatably driven in the opposite direction and at nearly the same speed (a slight speed difference may result as the inner and outer rotating ring members have different diameters and circumferences and thus have a different number of cogs or gear teeth along their respective opposed surfaces). Optionally, and desirably, the inner and outer ring members 220, 221 of apparatus 210 may be free to move or otherwise float in a generally vertical direction with respect to the support structure of the machine, the rotating blades, and the surface of the concrete. Such vertical movement may be facilitated by the teeth or cogs of surfaces 220*k*, 221*k* sliding generally vertically along the gear pins of the gear wheels or planetary gears 228.

Because the inner ring member is not driven via engagement with the blades, the inner and outer rotatable ring members may be driven at various speeds that are completely independent of the rotational speed of the two blade assemblies. This is made possible by the addition of the separate drive motor (such as a hydraulic motor or other suitable driving means) for the sole purpose of independently driving the rotatable ring working members. Such a construction also provides the further advantages of independent drives and operator-selective variable speed control of the now separate blade assemblies and the rotating ring concrete finishing members.

Figure 7:
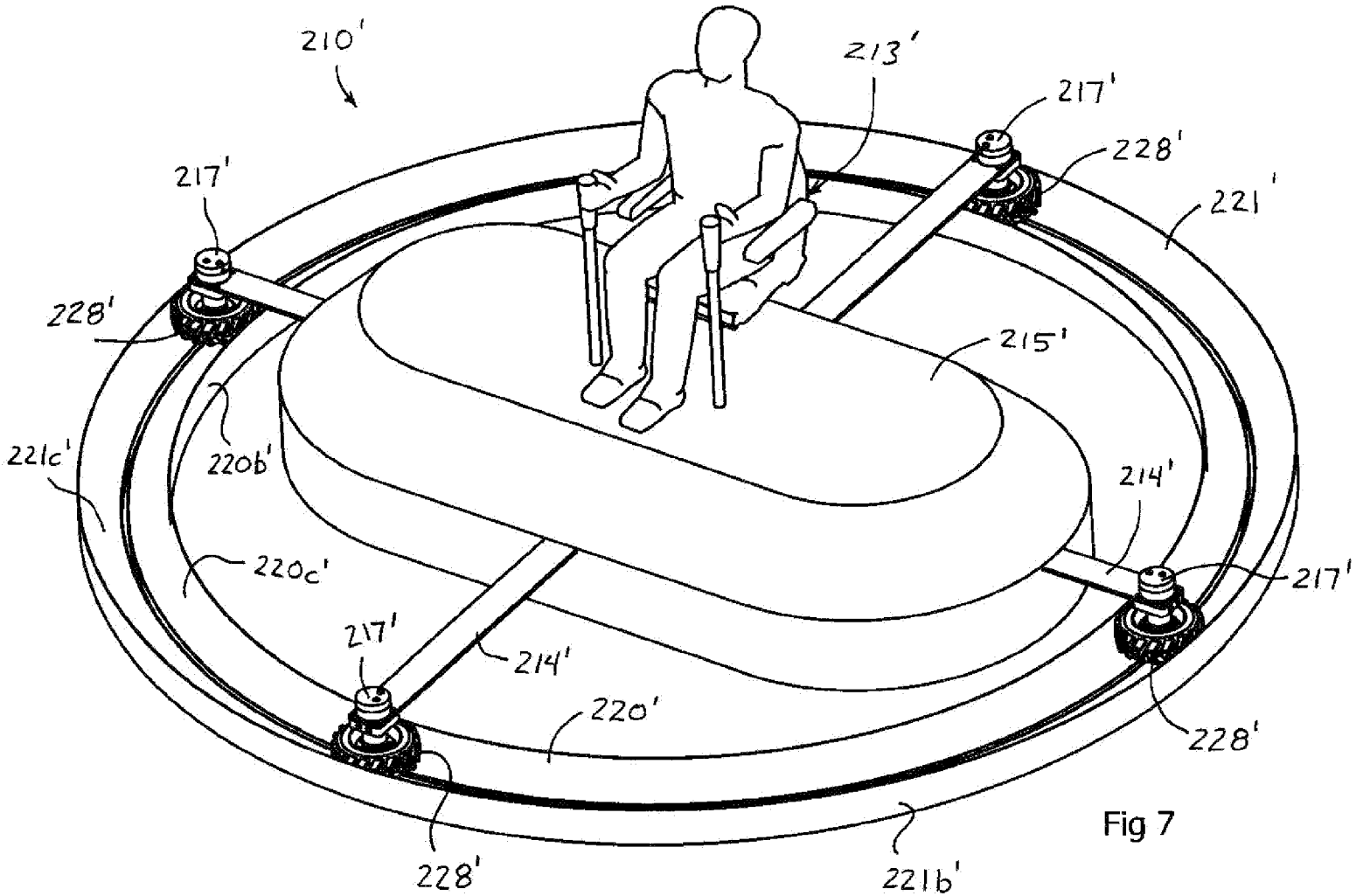
FIG. 7 is a perspective view of another concrete finishing apparatus for smoothing and leveling partially set-up concrete at a support surface in accordance with the present invention.

Optionally, and with reference to FIG. 7, the concrete finishing apparatus 210' may include a cover 215' (which may cover the blades and frame of the apparatus and upon which the operator station 213' may be positioned) with the two sets of rotating blades for engagement of a partially set-up concrete surface under the cover, and at least two rotatable ring working members 220', 221' loosely or movably or rotatably mounted at the outer periphery of the movable unit, with the two rotatable ring working members being driven in opposite directions via one or more driving devices 217', such as hydraulic motors or the like, rotatably driving one or more rotational drive members 228', such as planetary gears or rubber drive tires or the like, that are mounted to the frame portion 214' and that engage the opposed inside vertical faces or walls or surfaces of the respective rings.

In the illustrated embodiment, the inner rotatable ring working member 220' includes an inner wall or surface 220*b'* and a lower, generally planar working surface 220*c'*, while outer rotatable ring working member 221' includes an outer wall or surface 221*b'* and a lower, generally planar working surface 220*c'*. The rotational drive member or drive wheel or tire 228' frictionally engages the opposed surfaces 220*b'*, 221*b'*, and thus drives one ring member in one direction and the other ring member in the opposite direction in response to rotational driving of the drive wheel or tire (or wheels or tires) via the respective drive motor (or motors). Concrete finishing apparatus 210' may be otherwise similar to the concrete finishing devices discussed above, such that a detailed discussion of the devices need not be repeated herein.

Figure 8:
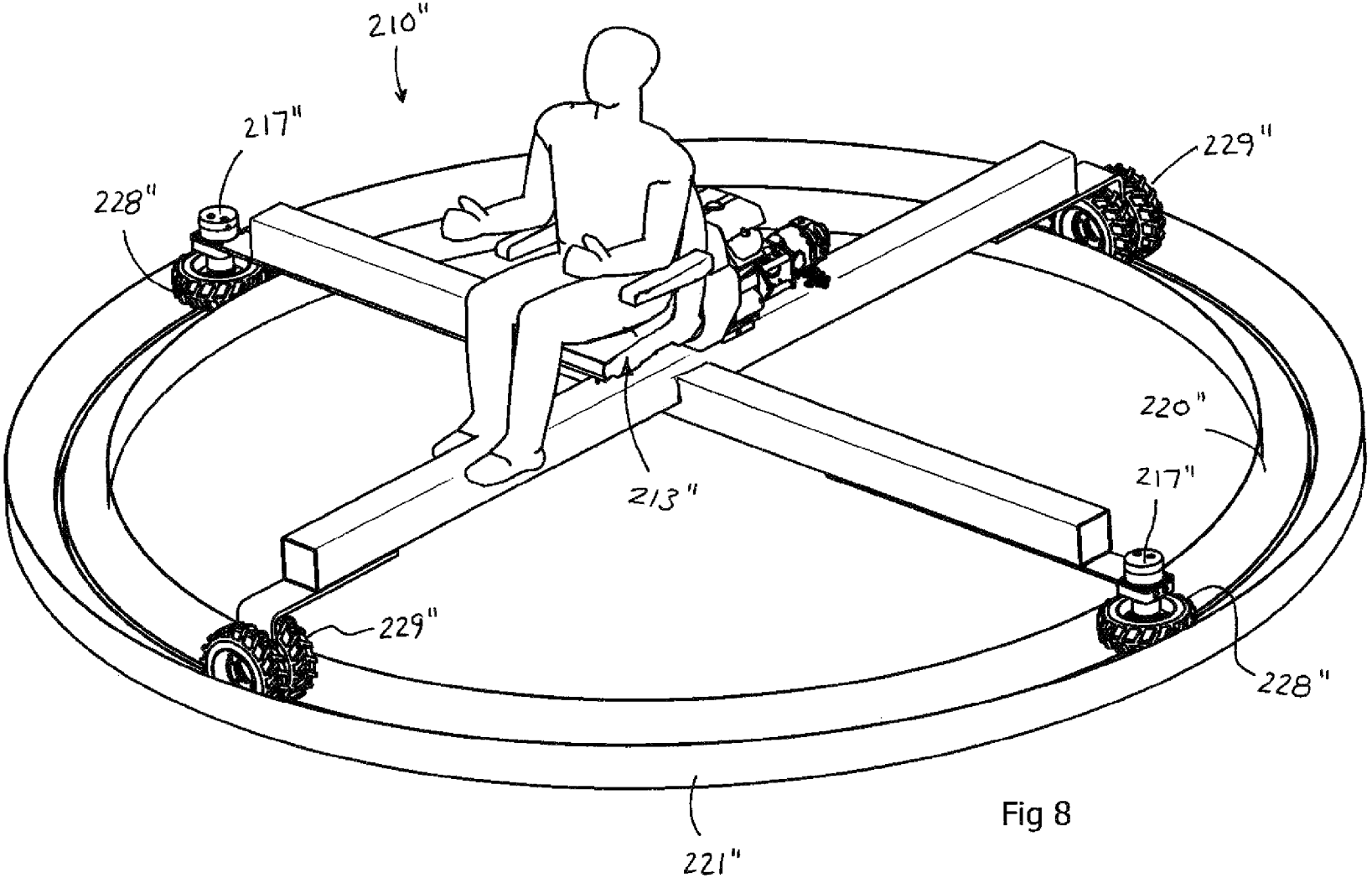
FIG. 8 is a perspective view of a concrete finishing apparatus for smoothing and leveling partially set-up concrete at a support surface in accordance with the present invention.
Figure 9:
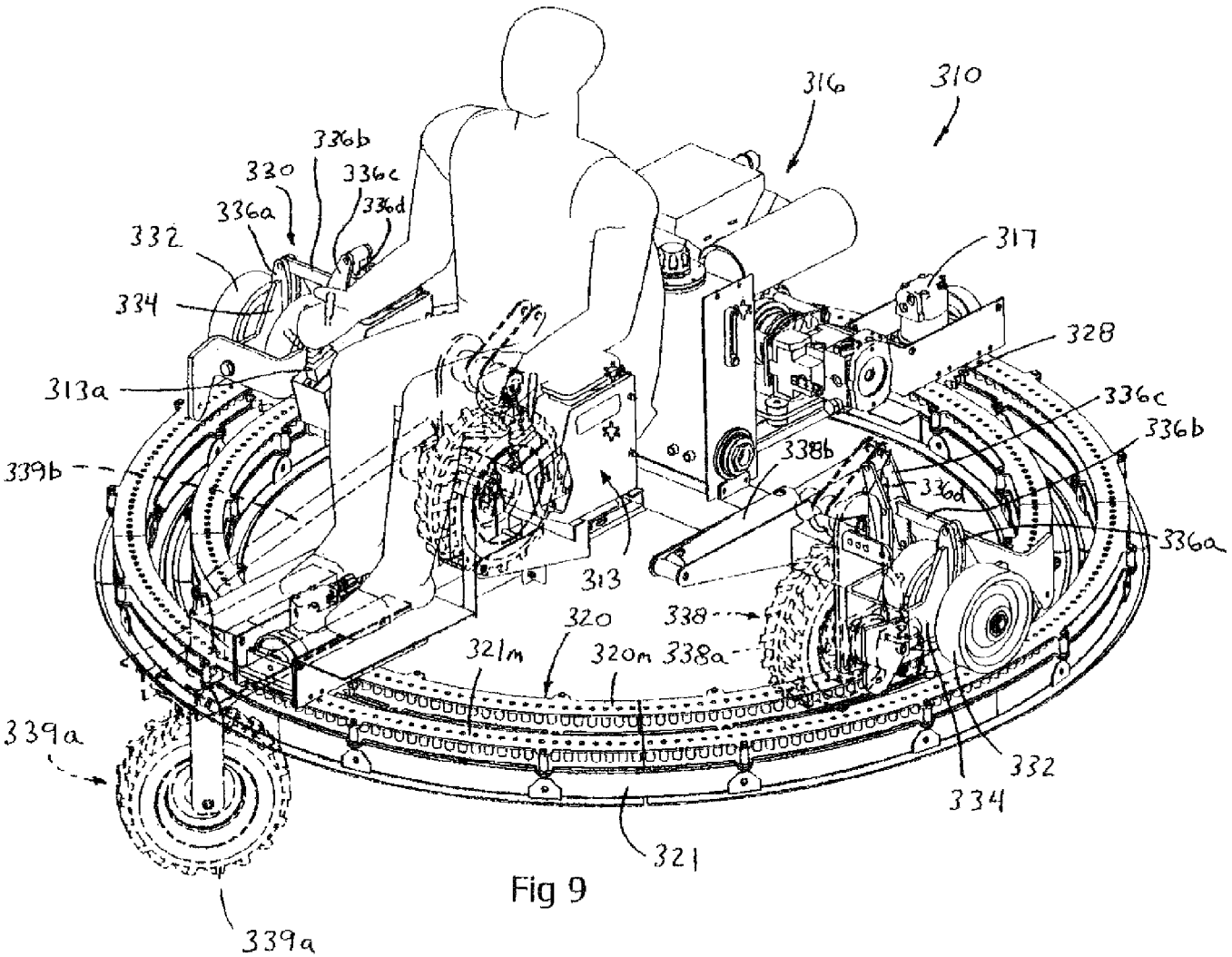
FIG. 9 is a perspective view of another concrete finishing apparatus for smoothing and leveling partially set-up concrete at a support surface in accordance with the present invention.
Figure 9B:
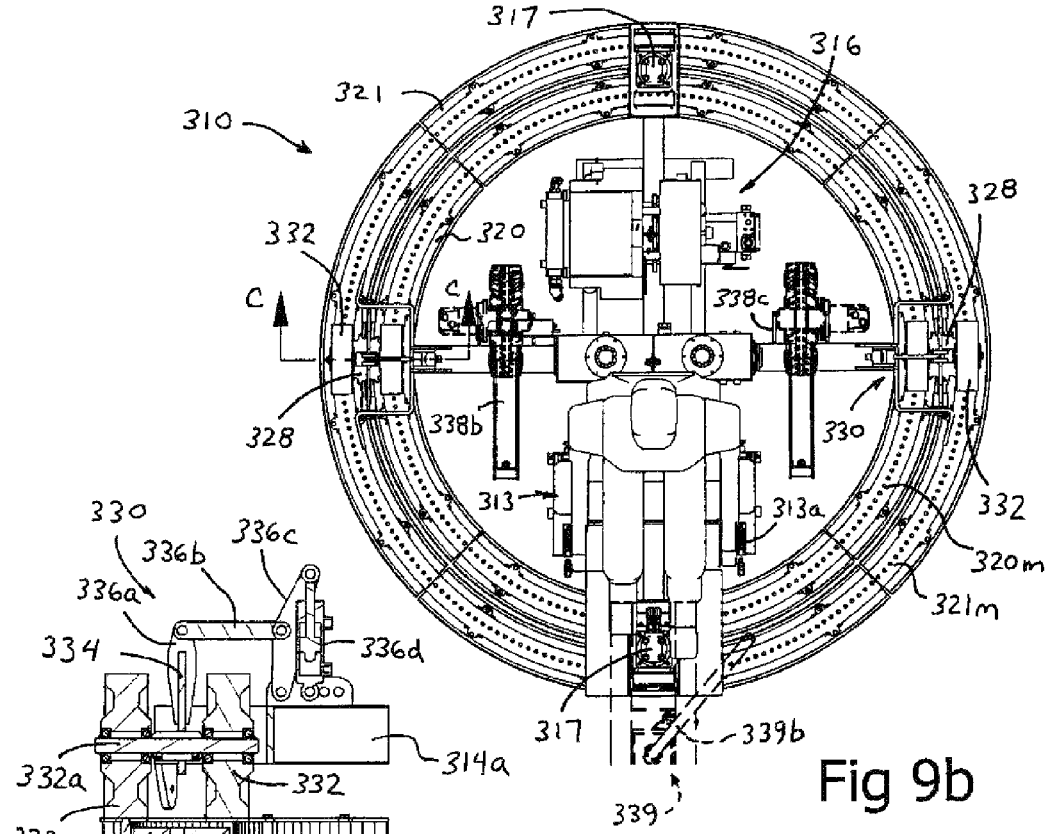
FIG. 9B is a top plan view of the concrete finishing apparatus of FIGS. 9 and 9A.
Figure 9C:
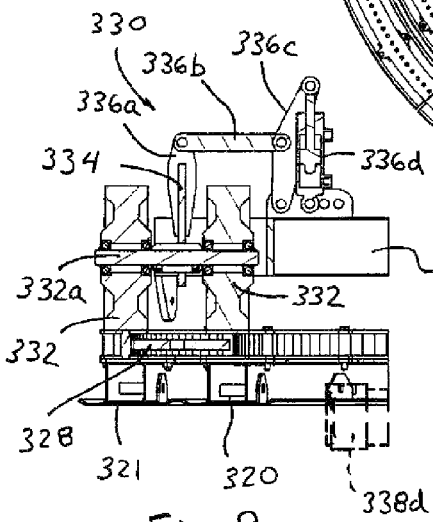
FIG. 9C is a sectional view of the tilting mechanism of the concrete finishing apparatus, taken along the line C-C in FIG. 9B.
Figure 9A:
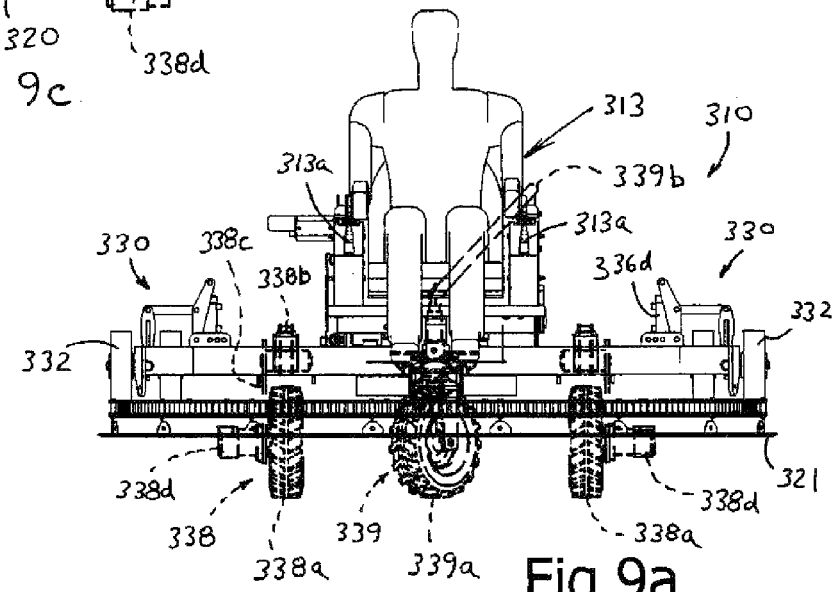
FIG. 9A is a front view of concrete finishing apparatus of FIG. 9.

Optionally, and with reference to FIG. 8, a concrete finishing apparatus 210" may not include rotating blades for engagement of a partially set-up concrete surface under the cover, but includes a frame portion 214" and at least two rotatable ring working members 220", 221" loosely mounted at the outer periphery of the movable unit for engagement of a partially set-up concrete surface, with the two rotatable ring working members being driven in opposite directions via one or more driving devices 217", such as hydraulic motors or the like, rotatably driving one or more rotational drive members 228", such as planetary gears or rubber drive tires or the like, that engage the opposed inside vertical faces or walls or surfaces of the respective rings. The stand alone unit may be steered by the operator at the operator station 213", such as by tilting or raising/lowering the rings with respect to one another, and while the two rotatable ring working members are driven in opposite directions via hydraulic motors and rubber drive tires at the inside vertical faces of the respective rings, such as discussed below. The tilting of the rings may be accomplished via tilting the ring rotation wheels 228", which may urge one of the rings downward and allow the other ring to raise upward so that the downward urged ring engages the concrete surface and causes the apparatus to move or rotate (because the other ring is in reduced contact or is not in contact with the concrete surface and thus does not counter the rotational forces of the downward urged ring) one way or the other. Optionally, and as shown in FIG. 8, the apparatus 210" may include a pair of ring rotation wheels 228" at respective opposite ends of a frame cross member and a pair of support wheels 229" at respective opposite ends of another frame cross member, such that the ring rotation wheels 228" are about 180 degrees apart and the support wheels 229" are likewise about 180 degrees apart.

Optionally, and with respect to FIGS. 9 and 9A-C, a concrete finishing apparatus 310 may or may not include rotating blades (not shown in FIGS. 9 and 9A-C) for engagement of a partially set-up concrete surface under the cover, but includes a frame portion 314 and at least two rotatable ring working members 320, 321 loosely mounted at the outer periphery of the movable unit for engagement of a partially set-up concrete surface, with the two rotatable ring working members being driven in opposite directions via one or more driving devices 317, such as hydraulic motors or the like, rotatably driving one or more rotational drive members 328, such as planetary gears or rubber drive tires or the like, that engage the opposed inside vertical faces or walls or surfaces of the respective rings. The apparatus 310 may include a power source or engine or power system 316 (such as an internal combustion engine and a hydraulic pump and reservoir for operating the hydraulic motors 317 and/or hydraulic motors 338*d* and/or the like). The stand alone unit may be steered by an operator at the operator station 313 by tilting or raising/lowering the rings with respect to one another, such as via a tilting mechanism 330, and while the two rotatable ring working members are driven in opposite directions via hydraulic motors and rubber drive tires at the inside vertical faces of the respective rings, such as in a similar manner as discussed above. Tilting of the ring rotation wheels may raise one ring upward while the other ring remains in contact with the concrete surface, which may cause the apparatus to move or rotate one way or the other (depending on the direction of rotation of the ring that is in contact with the concrete surface), such as discussed above.

In the illustrated embodiment, the frame portion 314 comprises a pair of elongated cross members with gear wheels or planetary gears 328 rotatably mounted at the outer ends of the frame cross members. The planetary gears 328 include teeth or pins that engage teeth or pins of the inner and outer ring members 320, 321, whereby rotation of at least one of the planetary gears 328 (such as via a hydraulic motor 317 or other suitable driving device or drive means) rotates the inner ring member 320 in one direction and the outer ring member 321 in the opposite direction, such as in a similar manner as discussed above. As also described above, the ring members 320, 321 may be loosely disposed at the periphery of the unit and may be vertically movable relative to the frame portion 314 and planetary gears 328 so as to float relative to one another during operation of the apparatus and so as to allow for movement and/or tilting of the ring members relative to one another in response to the tilting mechanism 330.

In the illustrated embodiment, tilting mechanism 330 comprises a pair of wheels or rollers 332 mounted at each end of the frame cross member 314*a*, and that are pivotable about a generally horizontal pivot axis to adjust the tilt of the outer ring member relative to the inner ring member. The wheels 332 are rotatable about a generally horizontal axis of rotation and rollingly engage an upper surface 320*m*, 321*m* of the ring members as the ring members are rotated in their opposite directions via the drive motors and planetary gears. The wheels 332 are rotatably mounted (such as via a common axle 332*a*) to a mounting plate 334, which is connected to or joined with or includes a linkage or arm 336*a* extending generally upwardly therefrom. The wheels 332 thus may be pivoted in response to pivotal movement of the linkage or arm 336*a*, such as in response to generally translational movement of another linkage or arm 336*b*, which has one end pivotally connected to an upper end of linkage or arm 336*a* and its opposite end pivotally connected to a linkage or arm 336*c*, which in turn is pivotally mounted to the frame cross member 314*a*. A linear actuator 336*d* (or other suitable actuating device) is mounted to the frame cross member and to an upper end of the linkage or arm 336*c*, while arm 336*b* is connected to a mid-region of arm 336*c*.

Thus, actuation (extension or retraction) of the linear actuator (which may comprise a hydraulic cylinder or electric actuator or the like) imparts a pivotal movement of arm 336*c* relative to the frame cross member, which imparts a generally translational movement of arm 336*b* in a radially outward direction (if the actuator is extended) or radially inward direction (if the actuator is retracted), which in turn imparts a pivotal movement of arm 336*a* and plate 334 and thus axle 332*a* and wheels 332. Such pivotal movement of axle 332*a* and wheels 332 thus adjust or moves or urges one of the ring members 320, 321 downward and allows the other ring member to move upward at that location. Because the wheel and arm configuration of the tilting mechanism is disposed at opposite ends of the frame cross member, and because the tilting mechanism may function to urge the inner ring member downward at each end of the frame cross member (such as via retracting the actuators at that ends of the frame cross member) or to urge the outer ring member downward at the ends of the frame cross member (such as via extending the actuators at that ends of the frame cross member), the wheel and arm configurations may cooperate to control the ring members in a suitable manner to steer or control the apparatus at the concrete surface.

Thus, the apparatus may be driven or controlled by an operator seated at a control station 313 or operator station of the apparatus. Optionally, user inputs or levers 313*a* may be provided at the operator station to allow the driver or operator to control the actuators and the rotational speed of the drive motors and the like during operation of the machine. For example, the operator may move a lever or input to actuate the actuators 336*d* (such as to actuate the actuators together), such as to extend the actuators to lower the outer ring and allow the inner ring to raise upwardly relative to the outer ring, in order to turn in one direction, and may move the lever or input in a different direction to actuate the actuators 336*d*, such as to retract the actuators to lower the inner ring and allow the outer ring to raise upwardly relative to the inner ring, in order to turn the apparatus in the other direction.

Optionally, the apparatus 310 may include a set of drop-down wheel assemblies 338, which include tires or wheels 338*a*, which may be raised to a level above the working surfaces of the ring members during operation of the concrete finishing apparatus, and which may be lowered to a level below the working surface of the ring members so as to raise the ring members above the support surface to allow for easier movement of the machine over general surfaces during transport from one location to another. The wheel assemblies 338 may be adjustable via an actuator 338*b* (such as a hydraulic cylinder or the like) that pivots a mounting arm 338*c* relative to the frame cross member 314*a* to raise and lower the wheels 338*a*. Optionally, one or more of the wheels 338*a* may be rotatably driven, such as via a hydraulic motor 338*d* or other suitable driving device or drive means. Optionally, and such as shown at the front of the apparatus, a wheel assembly 339 may include a wheel 339*a* and may be removably mounted to a mounting frame or bracket at the front of the apparatus. The front wheel 339*a* may be freely pivotable about a generally vertical axis and may be pivotable or steerable by the operator of the apparatus, such as via pivotal movement of a steering arm or control lever 339*b* or the like.

Figure 10:
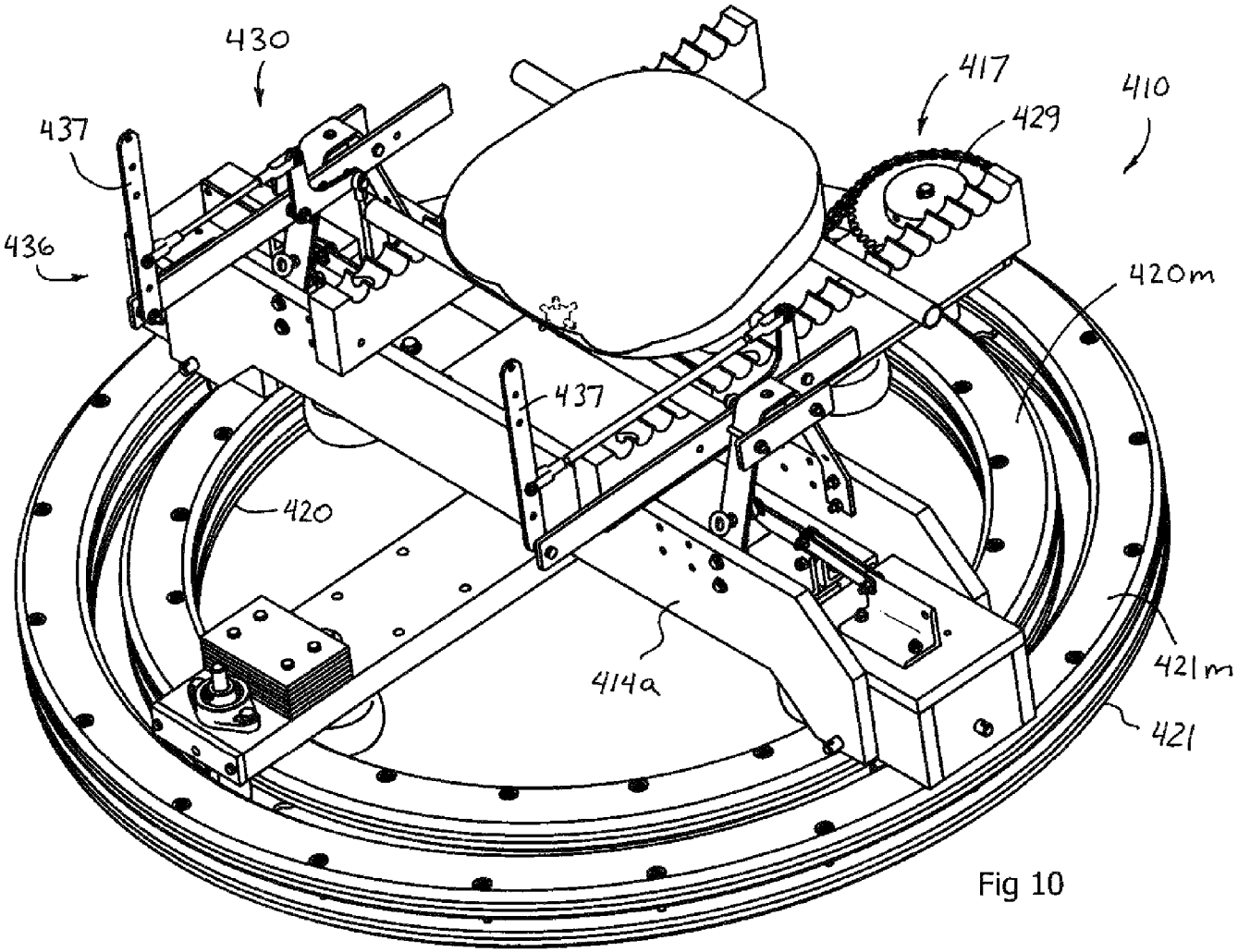
FIG. 10 is a perspective view of another concrete finishing apparatus for smoothing and leveling partially set-up concrete at a support surface in accordance with the present invention.

Optionally, and with reference to FIG. 10, a concrete finishing apparatus 410 may include a frame portion 414 and at least two rotatable ring working members 420, 421 loosely mounted at the outer periphery of the movable unit for engagement of a partially set-up concrete surface, with the two rotatable ring working members being driven in opposite directions via a driving device 417 rotatably driving one or more rotational drive members, such as a planetary gear or gears or rubber drive tires or the like being rotatably driven via a chain-driven gear 429 by a rotary drive device or motor or engine (not shown in FIG. 10). The planetary gears or tires engage the opposed inside vertical faces or walls or surfaces of the respective rings, as discussed above, so as to drive the rings in opposite directions. The stand alone unit may be steered by tilting or raising/lowering the rings with respect to one another, such as via a tilting mechanism 430, and while the two rotatable ring working members are driven in opposite directions via hydraulic motors and rubber drive tires at the inside vertical faces of the respective rings, such as in a similar manner as discussed above.

In the illustrated embodiment, tilting mechanism 430 comprises a pair of wheels or rollers or the like mounted at each end of the frame cross member 414*a*, and that are pivotable about a generally horizontal pivot axis to adjust the tilt of the outer ring member relative to the inner ring member. The wheels are rotatable about a generally horizontal axis of rotation and rollingly engage an upper surface 420*m*, 421*m* of the ring members as the ring members are rotated in their opposite directions via the drive motor and drive wheels or planetary gears. The wheels are rotatably mounted (such as via a common axle) to a mounting plate or structure that is connected to or joined with a linkage mechanism 436, which is operable to pivot the axle and wheels in response to the operator pivoting or moving or actuating a user input or lever 437, such as in a similar manner as discussed above.

Figure 11:
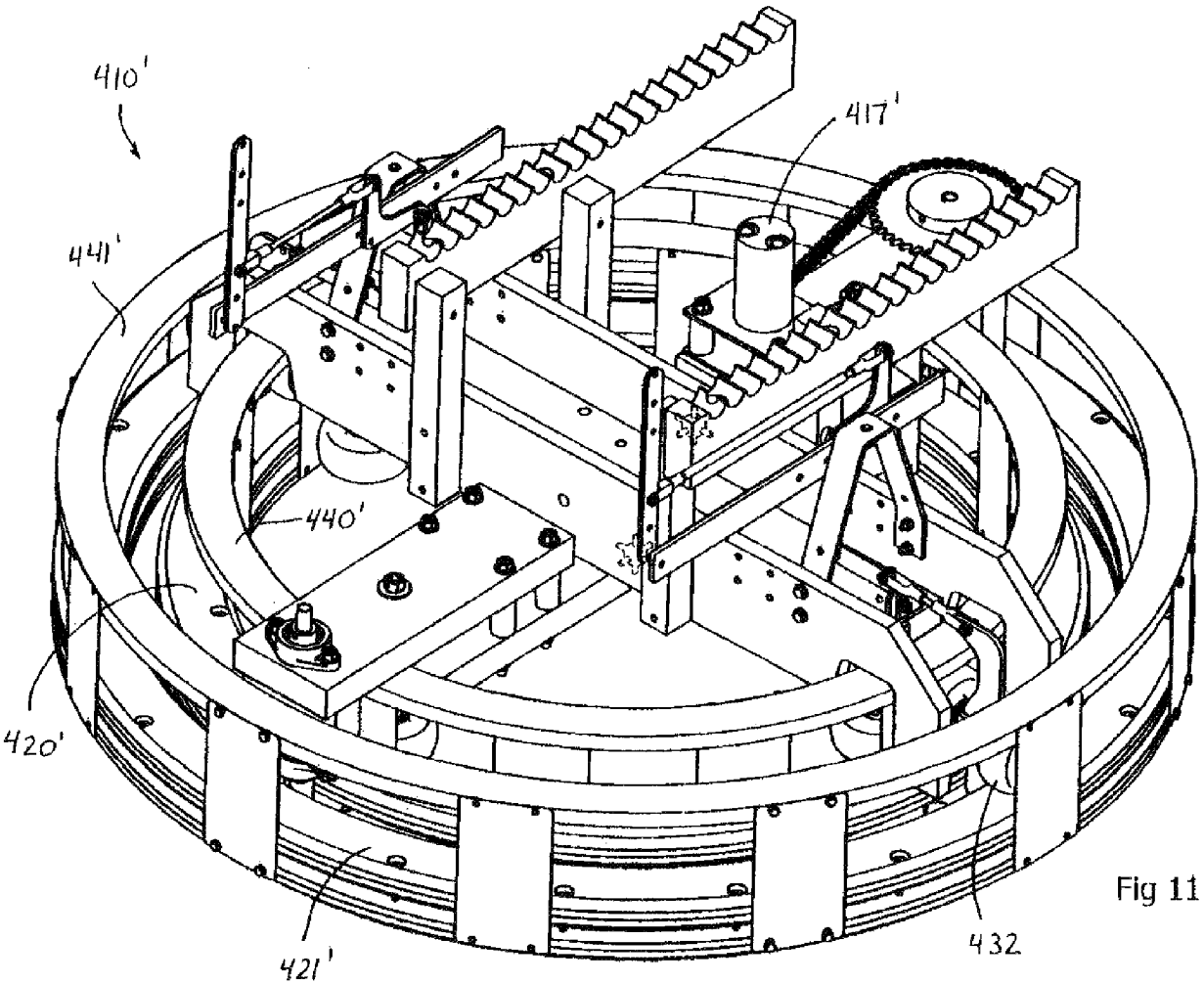
FIG. 11 is a perspective view of another concrete finishing apparatus of the present invention.

Optionally, and with reference to FIG. 11, a concrete finishing apparatus 410' may include upper members or lift rings 440', 441' disposed above the tilt wheels 432' and above and around the circumference of the respective ring members 420', 421'. Thus, when the tilt wheels 432' are tilted so that one of the wheels urges one of the ring members 420', 421' downward, the other tilt wheel urges against the lower surface of the respective lift ring 440', 441' to raise or lift the other ring member 420', 421' upward, in order to enhance the relative movement or tilting or raising/lowering of the ring members to enhance control of the apparatus on the concrete surface. For example, an operator may control the apparatus so as to urge the inner ring downward and to urge the outer ring upward so as to substantially reduce the contact of the outer ring at the concrete surface (and may raise the outer ring above the concrete surface) to turn in one direction and may control the apparatus so as to urge the outer ring downward and to urge the inner ring upward so as to substantially reduce the contact of the inner ring at the concrete surface (and may raise the inner ring above the concrete surface) to turn in the opposite direction to enhance the steering of the apparatus as it moves over the concrete surface.

As shown in FIG. 11, the apparatus is shown without a power source or engine and with the seat removed from the apparatus, in order to show a hydraulic drive motor 417' that may be driven by pressurized fluid, such as through a pair of hydraulic hoses connected to the motor and to a remotely stationed hydraulic power source. Thus, the apparatus may receive its power or pressurized fluid from a remote device, such that the apparatus need not include an engine and pump and reservoir and the like, such that the apparatus may have substantially reduced weight as compared to the other devices and machines discussed above. Concrete finishing apparatus 410' may be otherwise similar to concrete finishing apparatus 410, discussed above, such that a detailed discussion of the apparatus need not be repeated herein.

Figure 11A:
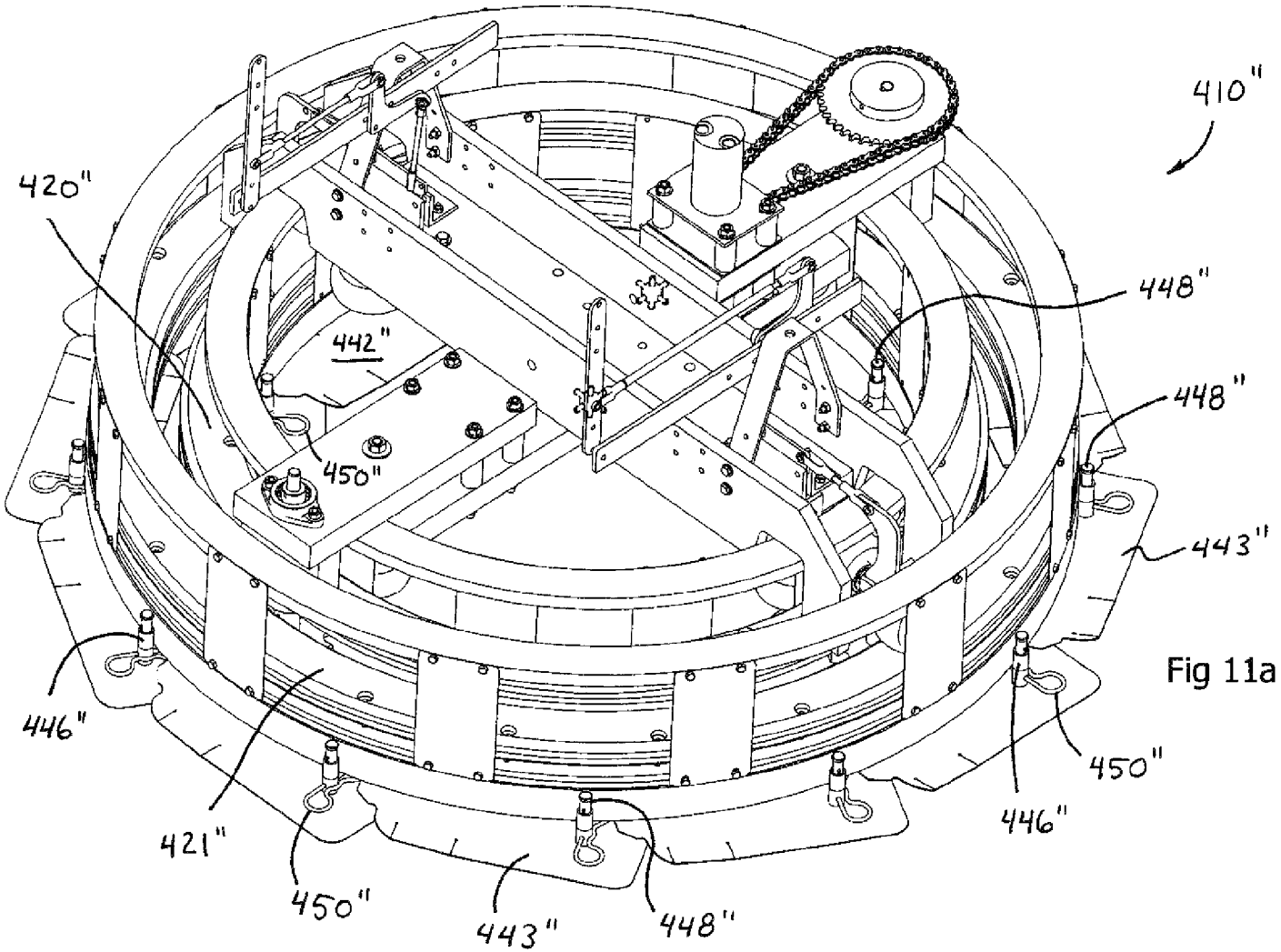
FIG. 11A is a perspective view of a concrete finishing apparatus similar to the apparatus shown in FIG. 11, with a series of trowelling blades added to the inner and outer rotatable ring working members.

Optionally, and with reference to FIG. 11A, a concrete finishing apparatus 410" may include a plurality of trowelling blades or pans 442", 443" attached to the lower surfaces of the respective ring members 420", 421". The trowelling pans provide a larger surface area that engages and works the concrete surface to further finish the concrete surface. The trowelling pans may be attached to the ring members after the apparatus has processed or worked the partially set up concrete surface.

In the illustrated embodiment, the trowelling pans 442", 443" are attached to the respective ring members 420", 421" via a hitch pin attachment assembly or configuration 444". For example, a plurality of pin receivers or collars 446" may be attached to the ring members and spaced apart around the circumference of the ring members (such as around the outer circumference of the outer ring member and around the inner circumference of the inner ring member). Each trowelling pan may include a mounting pin or support pin 448" extending upwardly therefrom, such as upwardly from a rearward region or trailing end region of the trowelling pan, whereby the mounting pin may be received in the respective collars 446" to position the trailing region of the trowelling pan, while the leading region of the trowelling pan may overlap or overlay the adjacent trowelling pan in the direction of rotation of the ring member. A hitch pin 450" (such as a cotter pin or the like) may be inserted through a hole or passageway in the collar and through a generally aligned hole or passageway through the mounting pin to secure the respective trowelling pan to the ring member. Optionally, and desirably, the mounting pins may have a plurality of holes or passageways spaced therealong, so that the level of the rear or trailing region of the trowelling pans may be adjusted via adjustment of the mounting pin along the collar and insertion of the hitch pin into a desired or appropriate one of the holes or passageways in the mounting pin.

Thus, each support pin includes multiple through holes for engagement of the hitch pin and to allow for the desired adjustment of the angle-of-attack between the blades or pans and the surface of the concrete, such as might be used for final concrete finishing and trowelling operations. For example, the pins may be lowered relative to the collars to increase the angle of attack of the blades or pans, or the pins may be raised relative to the collars to decrease the angle of attack of the blades or pans, depending on the particular application and operation of the concrete finishing apparatus. Concrete finishing apparatus 410" may be otherwise similar to concrete finishing apparatus' 410, 410', discussed above, such that a detailed discussion of the apparatus need not be repeated herein.

Figure 12A:
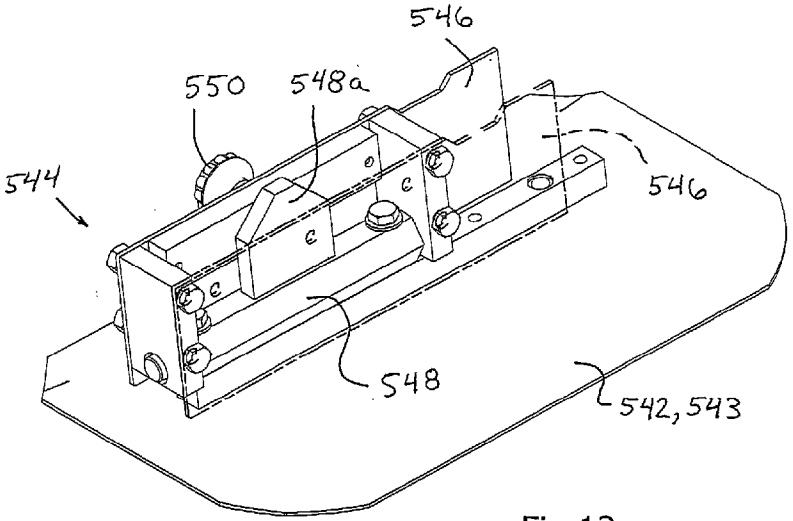
FIG. 12A is an enlarged perspective view of one of the adjustable trowelling blades of the apparatus of FIG. 12.
Figure 12:
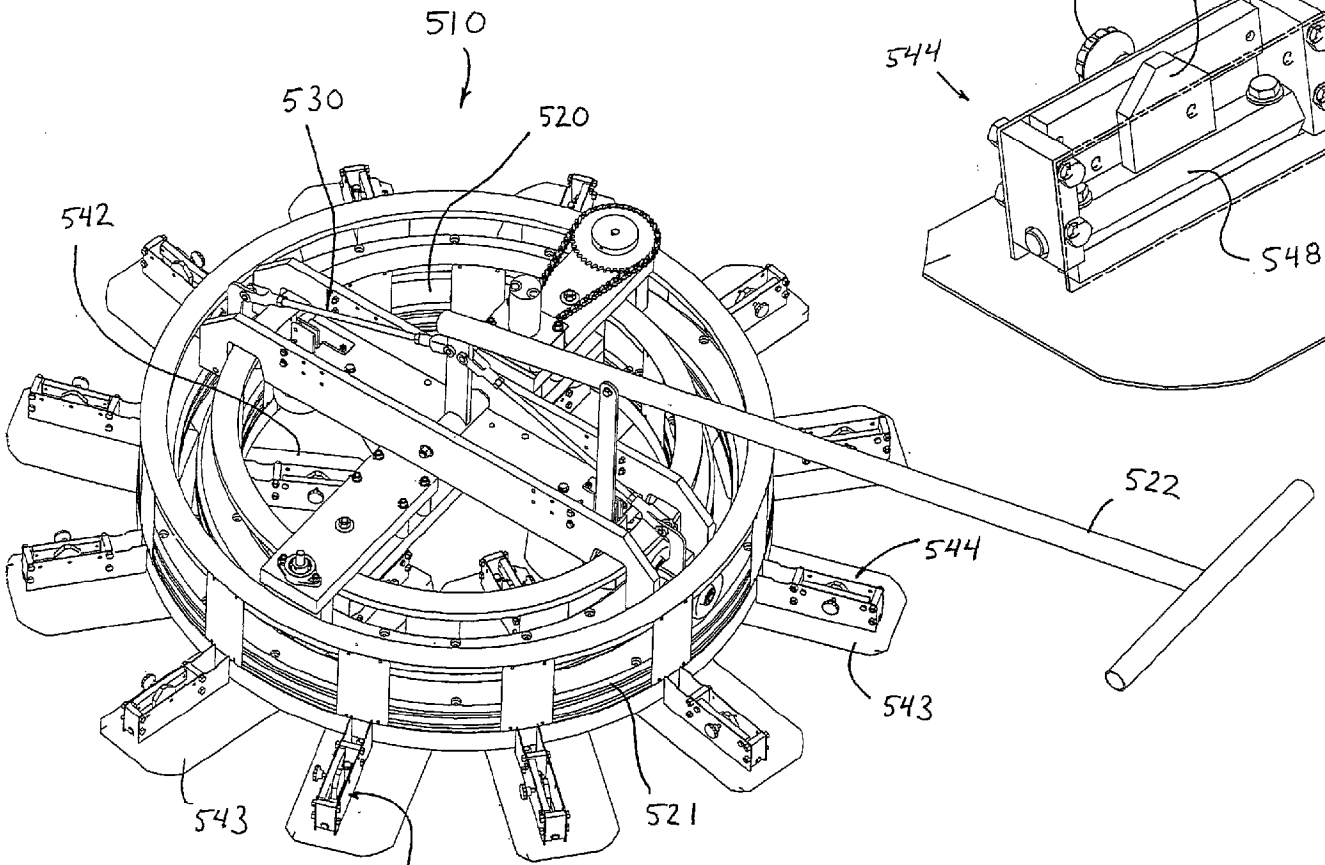
FIG. 12 is a perspective view of a walk-behind concrete finishing apparatus of the present invention, with a series of individual trowelling blades attached to the inner and outer ring working members.

Optionally, and with reference to FIGS. 12 and 12A, a concrete finishing apparatus 510 may comprise a walk-behind type of machine or device and may include a handle 522 for an operator to move the apparatus over the concrete surface. Concrete finishing apparatus 510 may include a plurality of trowelling blades or pans 542, 543 attached to the lower surfaces of the respective ring members 520, 521. The trowelling pans provide a larger surface area that engages and works the concrete surface to further finish the concrete surface. The trowelling pans may be attached to the ring members after the apparatus has processed or worked the partially set up concrete surface.

In the illustrated embodiment, the trowelling blades 542 extend radially inward from the inner ring member 520 and trowelling blades 543 extend radially outward from the outer ring Member 521. The trowelling blades may be detachably attached to the ring members or may be fixedly secured to the ring members, such as via welding or the like. Each trowelling blade may include an angle adjustment device 544 that is adjustable to adjust the angle of attack of the respective trowelling blade. In the illustrated embodiment, the adjustment device 544 comprises a bracket 546 that is fixedly mounted to the ring member and a pivot pin 548 that is connected to or joined to the trowelling blade. An angle adjustment knob 550 includes a threaded portion that threadedly extends through a threaded passageway in bracket 546 and engages an arm 548*a* extending from pivot pin 548. Thus, when the knob 550 is rotated, the engagement of the threaded portion moves relative to the bracket to impart a movement of the arm 548*a*, which imparts a pivotal movement of pivot pin 548 and thus pivotal adjustment of the trowelling blade. Other means for adjusting an angle of attack of the trowelling blades may be implemented while remaining within the spirit and scope of the present invention.

As can be seen in FIG. 12, the handle 522 may be connected to the linkage or tilt mechanism 530, whereby movement of the handle relative to the frame portion 514 may actuate or adjust the linkages to cause tilting or raising/lowering of one of the ring members relative to the other ring member, such as in a similar manner as discussed above. It is envisioned that the handle may be oriented as shown in FIG. 12, such that movement of the handle to push or pull the unit may affect the tilting/raising/lowering of the ring members, or the handle may be oriented or adjusted to be generally normal to the position shown in FIG. 12, such that an operator may rotate the handle to affect the tilting or raising/lowering of the ring members via the tilt mechanism. Concrete finishing apparatus 510 may be otherwise similar to concrete finishing devices or machines discussed above, such that a detailed discussion of the apparatus need not be repeated herein.

Figures 13, 13A:
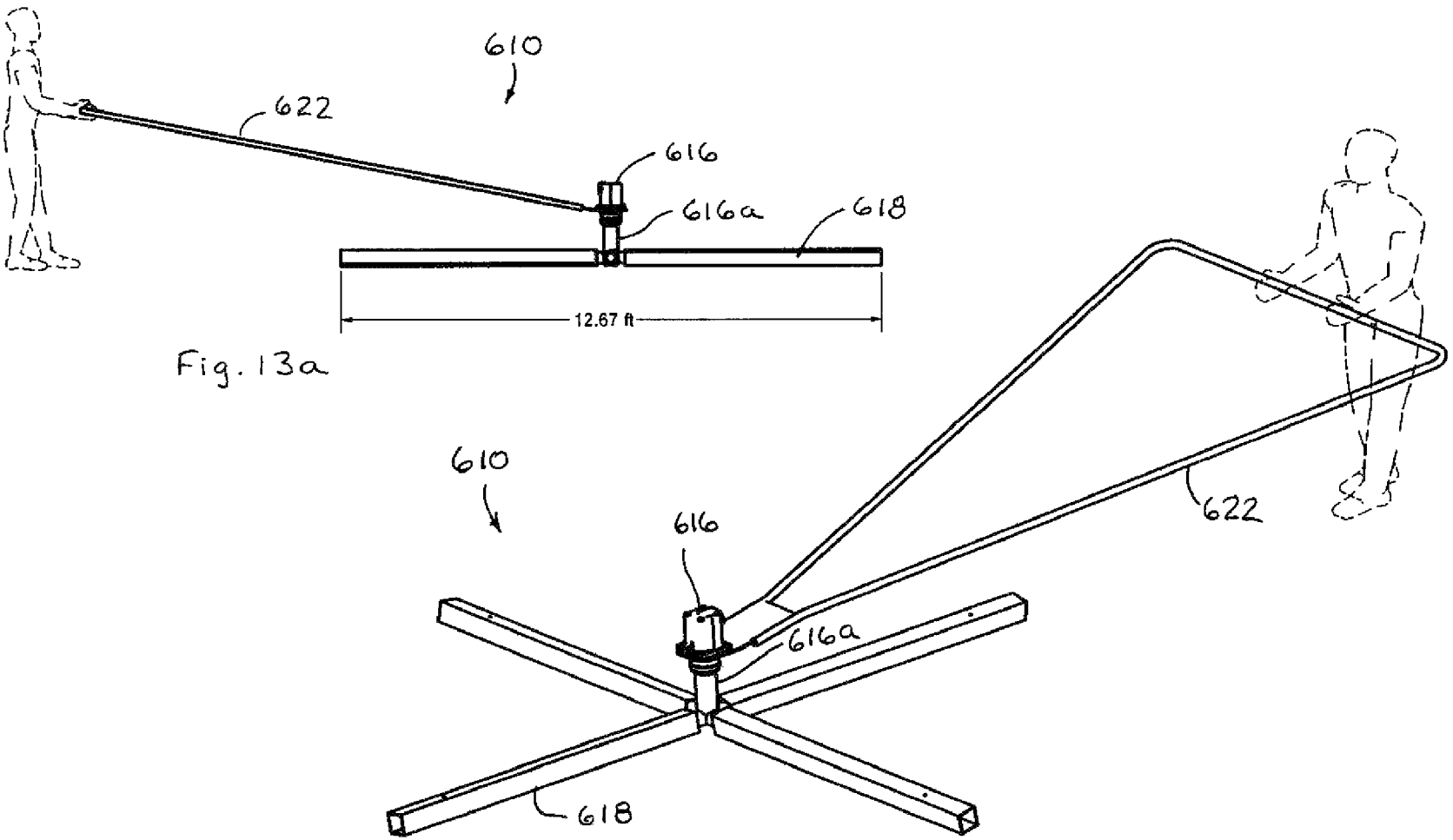
FIG. 13 is a perspective view of a large diameter, walk-behind, rotary bump cutter device for finishing concrete surfaces in accordance with the present invention.
FIG. 13A is a side elevation of the rotary bump cutter device of FIG. 13.

Optionally, and with reference to FIGS. 13 and 13A, a large diameter, walk-behind, rotary bump cutter device 610 may be provided for finishing concrete surfaces. Bump cutter device 610 includes a plurality of arms or members or blades 618 extending radially outward from a central axis or axle or output shaft 616*a* of a drive motor 616. The arms 618 may comprise elongated arms or blades with a generally planar lower surface for engaging the concrete surface. The drive motor is operable to rotate the elongated arms or blades 618 to rotate the arms or blades and to work or process the concrete surface, while an operator moves and/or controls the device via a handle 622.

Figure 14:
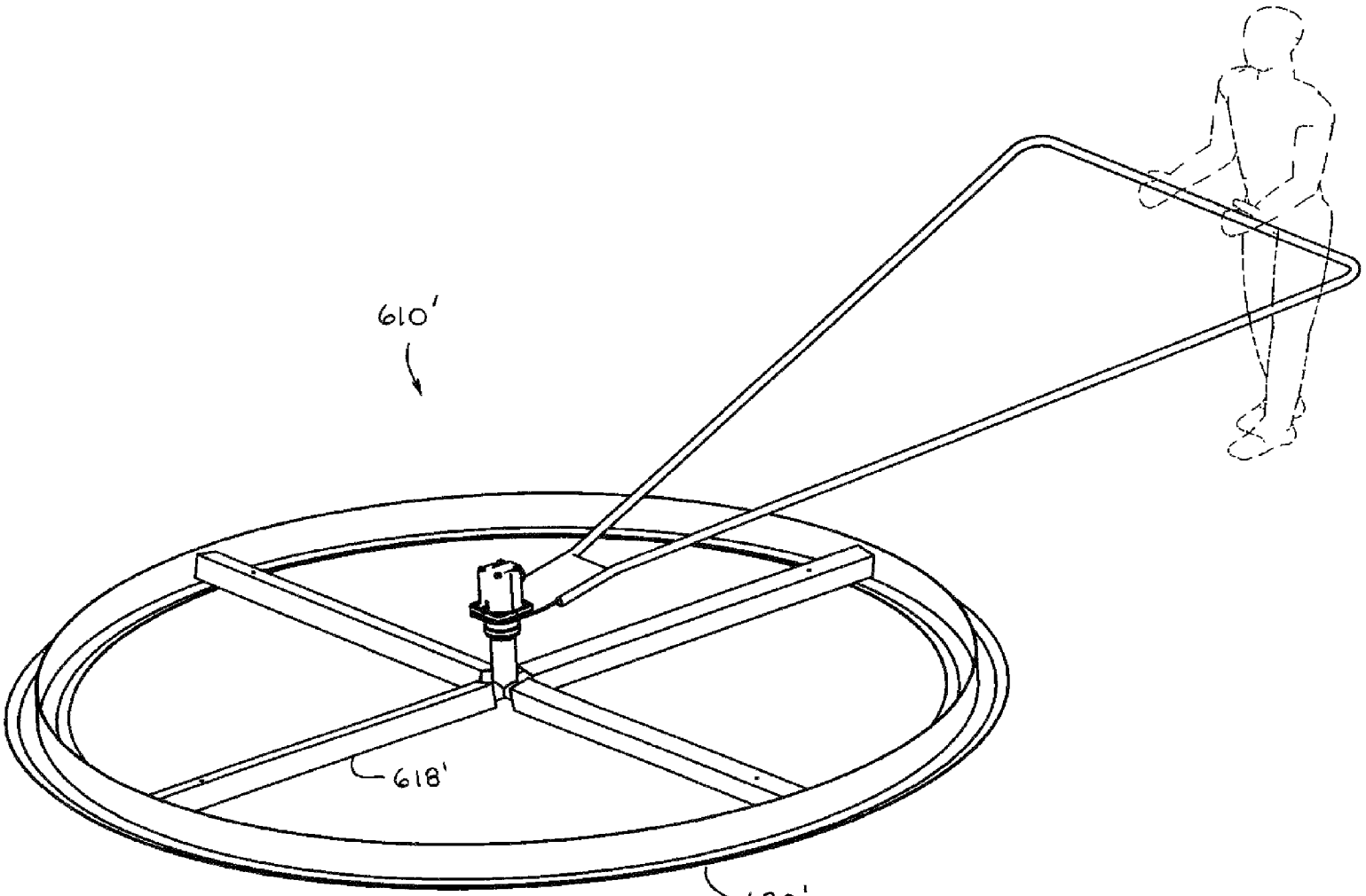
FIG. 14 is a perspective view of the large diameter, walk-behind, rotary bump cutter device of FIG. 13, shown with a rotatable ring working member.

Optionally, and with reference to FIG. 14, the rotary bump cutter device 610' may include a rotatable ring working member 620' that is rotatable with the arms or blades 618, such as in a similar manner as discussed above with respect to apparatus 10. Optionally, the rotatable ring working member 620' may float or may be vertically movable relative to the arms or blades to generally float at the concrete surface, such as also discussed above with respect to apparatus 10.

Figure 15:
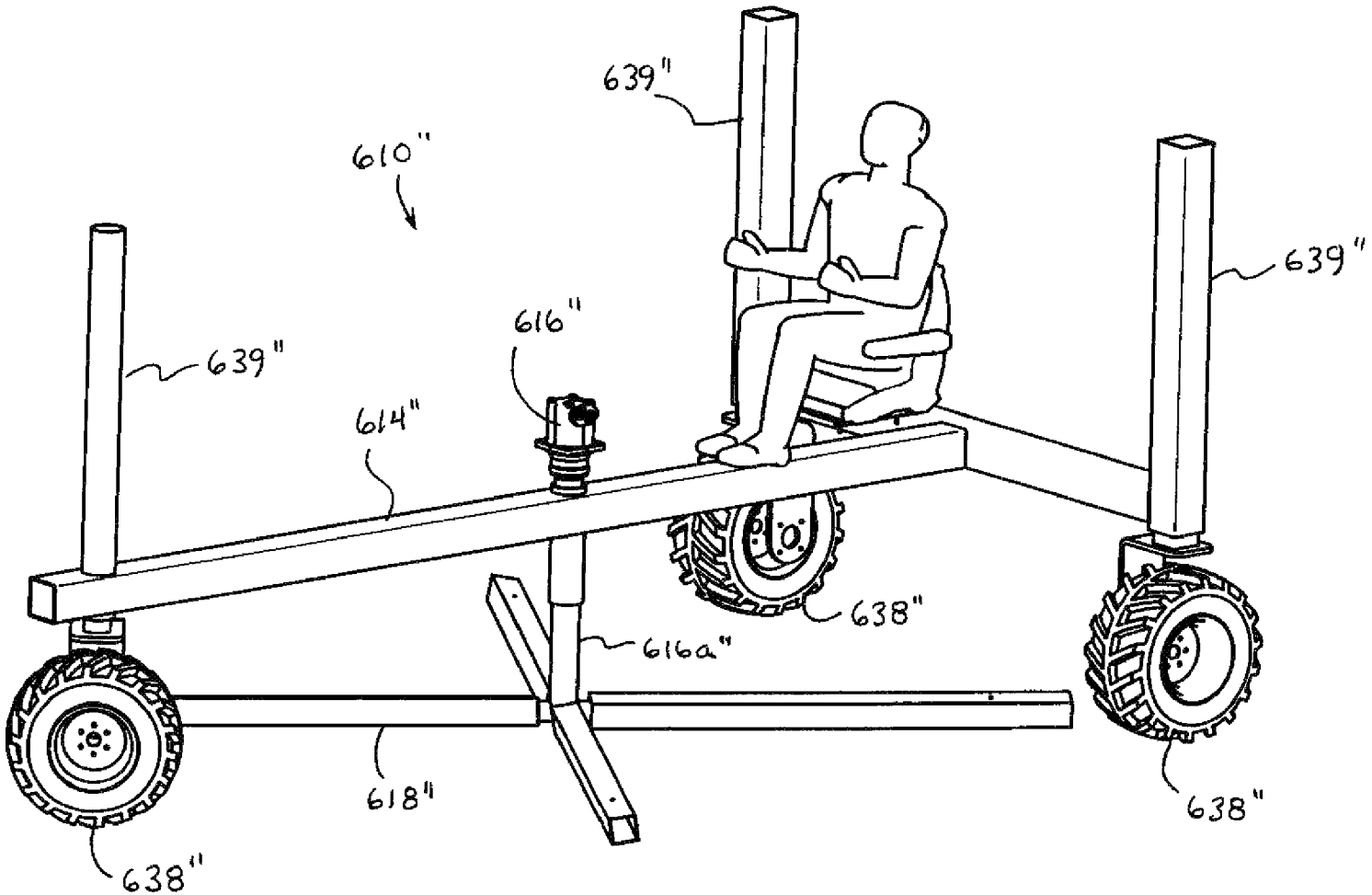
FIG. 15 is a perspective view of a large diameter rotary bump cutter device of the present invention, shown mounted to a support frame that includes an operator station for an operator to ride on the apparatus during use.

Optionally, and with reference to FIG. 15, a large diameter rotary bump cutter device 610" includes a plurality of arms or members or blades 618" extending radially outward from a central axis or axle or output shaft 616*a*" of a drive motor 616", with the motor and output shaft being mounted to a support frame 614" that includes an operator station for an operator to ride on the apparatus during use. The support frame 614" may comprise a wheeled frame, and may include three drive wheels 638" (with one or more of the drive wheels optionally being driven, such as via a hydraulic motor or the like), with telescoping supports 639" for the drive wheels so as to allow for adjustment and control of the height of the rotary bump cutter blades. The drive motor may be a hydraulic motor or other suitable drive device, and the support frame may support the power source (such as an engine and pump and reservoir for a hydraulic motor or the like), or the power source may be remotely located with hydraulic lines connecting to the drive motor.

Therefore, the present invention provides a concrete finishing apparatus or device or machine and method for smoothing and flattening partially set-up concrete to a close-tolerance surface. The concrete finishing apparatus of the present invention provides one or more rotatable ring portions for engaging a partially cured concrete surface to process or work the concrete surface while the apparatus is moved and supported on or over the partially set-up concrete surface. The rotatable ring finishing member is positioned at the concrete surface and rotatable to engage and finish the surface of the partially set-up concrete to a higher quality, closer-tolerance flat and level concrete floor surface. Optionally, the apparatus may include a pair of rotatable ring finishing members that may be rotatable in opposite directions to one another to enhance the floating and finishing processes and to transport any cement paste, sand, small aggregate, or concrete mix residue forward with the rotatable ring finishing members working surfaces to cut high areas and fill in any low areas as the concrete finishing apparatus moves over the partially set-up concrete. The ring member or members may be disposed around a periphery of the device and may be disposed around a plurality of trowelling blades or the like. The concrete smoothing and leveling apparatus of the present invention is capable of finishing a concrete floor or surface to a higher degree of quality than current methods and practices of concrete construction.

Changes and modifications in the specifically described embodiments may be carried out without departing from the principles of the present invention, which is intended to be limited only by the scope of the appended claims, as interpreted according to the principles of patent law.

The invention claimed is:

1. A concrete finishing apparatus for smoothing and leveling partially set-up concrete at a support surface, said concrete finishing apparatus comprising:

a frame portion;

a first concrete working member disposed at said frame portion and rotatable about a first axis of rotation that is generally vertical when said first concrete working member is supported at a generally horizontal support surface, wherein said first concrete working member comprises a ring-shaped member that has a circumferential concrete engaging surface for engaging the concrete surface substantially circumferentially around said first concrete working member during normal operation of said concrete finishing apparatus;

a second concrete working member disposed at said frame portion and rotatable about a second axis of rotation that is generally vertical when said second concrete working member is supported at a generally horizontal support surface, wherein said second concrete working member comprises at least one concrete engaging surface for engaging the concrete surface during normal operation of said concrete finishing apparatus; and wherein said circumferential concrete engaging surface of said first concrete working member and said at least one concrete engaging surface of said second concrete working member engage the partially set-up concrete surface at the support surface and rotate about said first and second axes of rotation to process the concrete surface.

2. The concrete finishing apparatus of claim 1, wherein said first concrete working member is disposed around the periphery of said second concrete working member.

3. The concrete finishing apparatus of claim 2, wherein said second concrete working member comprises at least one blade.

4. The concrete finishing apparatus of claim 2, wherein said second concrete working member comprises a plurality of blades.

5. The concrete finishing apparatus of claim 1, wherein said concrete finishing apparatus is steerable by selectively urging a portion of said first concrete working member downward or upward relative to said second concrete working member.

6. The concrete finishing apparatus of claim 1, wherein said concrete finishing apparatus is responsive to a laser control system that is operable to control or adjust an elevation of at least one of said first and second concrete working members relative to the frame portion during operation of said concrete finishing apparatus.

7. The concrete finishing apparatus of claim 1, wherein said concrete finishing apparatus is configured to support an operator so as to provide a ride-on apparatus.

8. The concrete finishing apparatus of claim 1, comprising a handle extending from said frame portion, wherein said concrete finishing apparatus is configured to comprise a walk-behind apparatus.

9. The concrete finishing apparatus of claim 1, wherein said first concrete working member rotates in a first direction of rotation and said second concrete working member rotates in a second direction of rotation, and wherein said second direction of rotation is opposite said first direction of rotation.

10. The concrete finishing apparatus of claim 1, wherein said first and second axes of rotation are generally coaxial.

11. The concrete finishing apparatus of claim 1, wherein said first axis of rotation is not coaxial with said second axis of rotation.

12. The concrete finishing apparatus of claim 1, wherein said second concrete working member comprises a second ring-shaped member that has a second circumferential concrete engaging surface for engaging the concrete surface substantially circumferentially around said second concrete working member during normal operation of said concrete finishing apparatus.

13. The concrete finishing apparatus of claim 12, wherein said concrete finishing apparatus is steerable by selectively urging a portion of said first concrete working member downward or upward and by selectively urging a portion of said second concrete working member downward or upward.

14. The concrete finishing apparatus of claim 13, wherein said first concrete working member rotates in a first direction of rotation and said second concrete working member rotates in a second direction of rotation, and wherein said second direction of rotation is opposite said first direction of rotation.

15. A method for smoothing and leveling partially set-up concrete at a support surface, said method comprising:

providing a concrete finishing apparatus having a first concrete working member and a second concrete working member, wherein said first concrete working member comprises a ring shaped member that has a circumferential concrete engaging surface for engaging the concrete surface substantially circumferentially around said first concrete working member during normal operation of said concrete finishing apparatus, and wherein said second concrete working member comprises at least one concrete engaging surface for engaging the concrete surface during normal operation of said concrete finishing apparatus;

rotating said first concrete working member about a first axis of rotation to process the partially set-up concrete surface with said circumferential concrete engaging surface, wherein said first axis of rotation is generally vertical when said first concrete working member is supported at a generally horizontal support surface; and rotating said second concrete working member about a second axis of rotation to process the partially set-up concrete surface with said at least one concrete engaging surface, wherein said second axis of rotation is generally vertical when said second concrete working member is supported at a generally horizontal support surface.

16. The method of claim 15, wherein providing a concrete finishing apparatus comprises providing a concrete finishing apparatus with said first concrete working member comprising an outer concrete working member disposed around a periphery of said second concrete working member.

17. The method of claim 16, wherein said second concrete working member comprises at least one blade.

18. The method of claim 15, wherein rotating said first concrete working member comprises rotating said first concrete working member in a first direction of rotation and wherein rotating said second concrete working member comprises rotating said second concrete working member in a second direction of rotation, said second direction of rotation being opposite said first direction of rotation.

19. The method of claim 18, wherein said second concrete working member comprises a second ring-shaped member that has a second circumferential concrete engaging surface for engaging the concrete surface substantially circumferentially around said second concrete working member during normal operation of said concrete finishing apparatus.

20. The method of claim 19, comprising steering said concrete finishing apparatus by selectively urging a portion of said first concrete working member downward or upward and by selectively urging a portion of said second concrete working member downward or upward.

21. A method for smoothing and leveling partially set-up concrete at a support surface, said method comprising:

providing a concrete finishing apparatus having a first concrete working member and a second concrete working member, wherein said second concrete working member comprises an inner ring-shaped concrete working member and wherein said first concrete working member comprises an outer concrete working member disposed around a periphery of said second concrete working member;

rotating said first concrete working member about a first axis of rotation to process the partially set-up concrete surface, wherein said first axis of rotation is generally vertical when said first concrete working member is supported at a generally horizontal support surface; and rotating said second concrete working member about a second axis of rotation to process the partially set-up concrete surface, wherein said second axis of rotation is generally vertical when said second concrete working member is supported at a generally horizontal support surface.

22. A concrete finishing apparatus for smoothing and leveling partially set-up concrete at a support surface, said concrete finishing apparatus comprising:

a frame portion;

a first concrete working member disposed at said frame portion and rotatable about a first axis of rotation that is generally vertical when said first concrete working member is supported at a generally horizontal support surface;

a second concrete working member disposed at said frame portion and rotatable about a second axis of rotation that is generally vertical when said second concrete working member is supported at a generally horizontal support surface, wherein said second concrete working member comprises an inner ring-shaped concrete working member and wherein said first concrete working member comprises an outer generally ring-shaped concrete working member disposed around the periphery of said second concrete working member; and wherein said first and second concrete working members engage the partially set-up concrete surface at the support surface and rotate about said first and second axes of rotation to process the concrete surface.

* * * * *